US009499970B2

(12) United States Patent
Milo et al.

(10) Patent No.: US 9,499,970 B2
(45) Date of Patent: Nov. 22, 2016

(54) METHOD AND APPARATUS FOR BUILDING A STRUCTURE

(75) Inventors: Thomas Kevin Milo, Akron, OH (US); Angelina Lucia Milo, Akron, OH (US)

(73) Assignee: International Shelter Solutions LLC, Akron, OH (US)

( * ) Notice: Subject to any disclaimer, the term of this patent is extended or adjusted under 35 U.S.C. 154(b) by 0 days.

(21) Appl. No.: 13/474,123

(22) Filed: May 17, 2012

(65) Prior Publication Data

US 2012/0291362 A1 Nov. 22, 2012

Related U.S. Application Data

(60) Provisional application No. 61/486,971, filed on May 17, 2011.

(51) Int. Cl.
*E04H 15/20* (2006.01)
*E04B 1/16* (2006.01)

(52) U.S. Cl.
CPC ..... *E04B 1/169* (2013.01); *E04B 1/165* (2013.01); *E04H 15/20* (2013.01); *E04H 2015/201* (2013.01); *E04H 2015/204* (2013.01); *E04H 2015/206* (2013.01); *E04H 2015/207* (2013.01)

(58) Field of Classification Search
CPC ..... E04H 4/06; E04H 4/103; E04H 4/106; E04H 15/20; E04H 15/22; E04H 2015/20; E04H 2015/201; E04H 2015/202; E04H 2015/203; E04H 2015/204; E04H 2015/205; E04H 215/206; E04B 1/169
USPC ..... 52/1, 2.11, 2.13, 2.17, 2.18, 2.19, 2.21, 52/2.22, 2.23, 2.24, 2.25, 23, 63, 653.2, 52/742.1, 742.13
See application file for complete search history.

(56) References Cited

U.S. PATENT DOCUMENTS 2,718,014 A 9/1955 Mizrach et al.
2,812,769 A 11/1957 Schaefer et al.
2,875,771 A 3/1959 Brewin
(Continued)

FOREIGN PATENT DOCUMENTS

CN 101532393 A 9/2009
FR 1104920 A 11/1955
(Continued)

OTHER PUBLICATIONS

PCT International Search Report, PCT/ISA/210, 3 pages.
(Continued)

*Primary Examiner* — Ryan Kwiecinski
(74) *Attorney, Agent, or Firm* — Calfee, Halter & Griswold LLP

(57) ABSTRACT

A shelter assembly has a frame having a plurality of fillable support members, each having a hollow portion for receiving a filling material. The support members are configured to form a structure wherein the support members form walls of the structure. The shelter assembly has a plurality of columns which form corner posts of a structure and a plurality of walls which are removably attached to a pair of adjacent columns. The walls have support members to which at least one panel is attached. The support members are secured to a pair of adjacent columns via fasteners. An upper portion forms a roof of the structure wherein the columns are attached to coupling members of the upper portion.

37 Claims, 26 Drawing Sheets

(56) References Cited

U.S. PATENT DOCUMENTS 3,665,968 A 5/1972 De Putter
3,877,491 A 4/1975 Thastrup
3,994,102 A * 11/1976 Johnson ..... E04H 15/20 446/220
4,068,429 A 1/1978 Moore
4,078,348 A 3/1978 Rothman
4,158,032 A 6/1979 Boon
4,255,824 A 3/1981 Pertchik
4,309,851 A * 1/1982 Flagg ..... E04H 15/006 446/110
4,399,645 A * 8/1983 Murphy ..... E04B 1/7604 52/2.11
4,422,552 A 12/1983 Palmer
5,007,212 A 4/1991 Fritts et al.
5,247,768 A * 9/1993 Russo ..... E04H 15/20 52/2.13
5,318,470 A 6/1994 Denny
5,412,822 A * 5/1995 Kelly ..... A47C 4/54 5/654
5,546,707 A 8/1996 Caruso
5,570,544 A * 11/1996 Hale ..... E04H 15/20 52/2.11
5,661,942 A * 9/1997 Palmer ..... E04H 15/48 135/156
5,697,198 A * 12/1997 Ponder ..... E04B 1/7604 52/404.1
5,765,333 A * 6/1998 Cunningham ..... E04B 1/165 52/281
5,987,822 A * 11/1999 McNiff ..... E04H 15/20 135/125
6,029,404 A 2/2000 Lewis
6,148,576 A 11/2000 Janopaul, Jr.
6,223,757 B1 * 5/2001 Horvath ..... A63H 33/30 134/123
6,260,306 B1 7/2001 Swetish et al.
6,282,843 B1 * 9/2001 Shibaike ..... E04H 15/20 52/2.11
6,322,454 B1 * 11/2001 Gordon ..... A63B 69/0048 472/134
6,463,699 B1 10/2002 Bailey et al.
6,679,007 B1 * 1/2004 Minchew ..... A63H 33/008 135/95
6,929,016 B2 * 8/2005 Lee ..... E04H 15/20 135/126
D510,118 S 9/2005 Smith
6,948,204 B2 9/2005 Chae
7,181,877 B2 * 2/2007 Quade ..... E04H 15/20 40/610
7,284,982 B2 10/2007 Brattesani
7,878,877 B2 * 2/2011 Scherba ..... A63G 9/00 446/220
8,752,336 B1 6/2014 Ozsuer
8,943,754 B2 2/2015 Brensinger
8,984,814 B2 3/2015 Brensinger et al.
2002/0083653 A1 7/2002 Hilbert
2003/0095834 A1 * 5/2003 Witcher ..... E01F 15/065 404/6
2004/0261324 A1 12/2004 Tewari
2005/0029148 A1 * 2/2005 Rust ..... B65D 81/3272 206/523
2005/0284031 A1 * 12/2005 Chen ..... A63G 31/12 52/2.11
2007/0234651 A1 * 10/2007 Gage ..... E04B 1/02 52/173.2
2008/0295417 A1 12/2008 Turcot
2008/0313970 A1 12/2008 Turcot
2009/0019784 A1 1/2009 Tinker et al.
2009/0249701 A1 * 10/2009 Turcot ..... E04H 15/20 52/2.18
2009/0264042 A1 * 10/2009 Chen ..... A63G 31/007 446/221
2010/0139175 A1 6/2010 Warner et al.
2010/0175330 A1 7/2010 Turcot
2010/0322703 A1 12/2010 Horwitz
2011/0023378 A1 * 2/2011 Hogue ..... E04H 1/1272 52/2.18
2011/0253184 A1 10/2011 Mills
2012/0042578 A1 * 2/2012 Chen ..... A63C 19/08 52/2.17
2012/0090248 A1 4/2012 Thompson
2012/0131857 A1 * 5/2012 Ross-Da Silva ..... E04H 15/20 52/2.18
2012/0174511 A1 7/2012 Harding
2012/0291362 A1 11/2012 Milo et al.
2014/0007521 A1 * 1/2014 McMahon ..... E04H 3/16 52/2.11

FOREIGN PATENT DOCUMENTS

FR 2341017 A1 9/1977
FR 2584762 A1 1/1987
FR 2683248 A1 5/1993
FR 2919646 A1 2/2009
RU 2012754 C1 5/1994
WO 03085226 A1 10/2003
WO 2005017291 A1 2/2005

OTHER PUBLICATIONS

European Patent Office, Search Report and Opinion, dated Feb. 2, 2015, in Related Application No. EP12784948.7.
United States Patent and Trademark Office Non-Final Office Action relating to U.S. Appl. No. 14/514,065 dated Apr. 10, 2015.
First Office Action issued by the Chinese State Intellectual Property Office dated May 14, 2015 relating to Chinese Patent Application No. 201280035513.5.
First Office Action Search Report issued by the Chinese State Intellectual Property Office dated May 14, 2015 relating to Chinese Patent Application No. 201280035513.5.
International Search Report and Written Opinion of the International Searching Authority in related International Application No. PCT/US12/38352 dated Jul. 30, 2012.
International Search Report and Written Opinion of the International Searching Authority in related International Application No. PCT/US14/60490 dated Feb. 5, 2015.
International Preliminary Report on Patentabilily from PCT/US12/38352 dated Nov. 19, 2013.

* cited by examiner

METHOD AND APPARATUS FOR BUILDING A STRUCTURE

CLAIM OF PRIORITY

This application claims priority from provisional patent application Ser. No. 61/486,971 filed on May 17, 2011 which is hereby incorporated by reference in its entirety.

BACKGROUND OF THE DISCLOSURE

The disclosure relates to building structures. More particularly, it relates to the method and apparatus for building temporary or permanent structures for use as shelters.

There are many instances where a temporary structure is needed to provide shelter. For example, natural disasters such as hurricanes, tornadoes, tsunamis, earthquakes and floods often render thousands of people homeless, either temporarily or permanently. Oftentimes, victims of such disasters need shelter, at least on a temporary basis. Tents are often used for shelters, but are not very stable or durable and can only be used for a short duration of time. Tents also do not always provide adequate shelter from the elements, such as rain, snow or excessive heat or cold. Tents also are not effective at providing insulation.

Thus, it is desirable to provide a structure which is easy to assemble and disassemble, and which can provide an insulated shelter which is sturdy and durable can be used for either a short-term or long-term basis.

The structure can be used for other applications as well, such as during military operations or as homes for third world countries or homeless people.

Thus, there is a need for temporary or permanent structures which overcome the above-mentioned deficiencies and others, while providing improved overall results.

SUMMARY OF THE DISCLOSURE

The disclosure relates to building structures. More particularly, it relates to the method and apparatus for building temporary or permanent structures for use as shelters.

In accordance with one aspect of the disclosure, a shelter assembly has a frame having a plurality of fillable support members, each having a hollow portion for receiving a filling material. The support members are configured to form a structure wherein the support members form walls of the structure.

In accordance with another aspect of the disclosure, shelter assembly has a plurality of columns which form corner posts of a structure; and a plurality of walls which are removably attached to a pair of adjacent columns. The walls include support members to which at least one panel is attached, wherein the support members are secured to a pair of adjacent columns via fasteners. An upper portion forms a roof of the structure, wherein the columns are attached to the corner members of the upper portion.

In accordance with another aspect of the disclosure, a method of assembling a shelter assembly, includes the steps of: providing a roof assembly which has a plurality of fillable support members; injecting filling material into the roof support members by inserting a nozzle of a filling gun into a fill valve located on each of the support members; installing the roof assembly onto columns at opposite corners of the roof assembly by inserting the columns into coupling members at corners of the roof assembly; providing wall assemblies formed by flexible support members and at least one panel; filling the support members of the wall assemblies by injecting filling material into the wall support members; and securing the wall assemblies to the columns by fasteners.

One aspect of the disclosure is to provide a structure which is durable, rigidly supported and can be easily assembled and disassembled.

Another aspect of the disclosure is support members are chambers which may be filled with foam, concrete, or any fill material which can be held together by binders or by being packed, to provide rigidity and/or insulating value to the structure.

Another aspect of the disclosure is chambers which may be filled by air, gas, water, or any other fluid which has a high or low viscosity to provide insulation and/or support to the structure.

Another aspect of the disclosure is filled containment structures (such as tubes or pipes) which form troughs or channels for housing electrical wiring.

Another aspect of the disclosure is various center wall sections which have chambers formed in a ribbed or quilted arrangement to form a combination of foam filled or storage chambers such as for water or other liquids.

Still another aspect of the disclosure is a plurality of fill valves placed intermittently along the lengths of the foam chambers for completely filling the chambers with foam.

Another aspect of the disclosure is a slit valve having a lip seal for forming a seal around a foam filling gun.

Still another aspect of the disclosure is a two-part polyurethane foam mixture which includes a catalyst for fast curing of the foam which allows for fast filling of the foam chambers while minimizing or eliminating air or gas voids and avoiding compression damage of the foam which is being layered.

Another aspect of the disclosure is a valve used for injecting foam or any other fill material uniformly into the fill chambers which may have a plurality of shapes, such as "t-shape", "v-shape", etc.

Another aspect of the disclosure is a modular arrangement of frame structures which are connected by a flap or tarp.

Another aspect of the disclosure is removable and interchangeable walls having support members and panels which are removably secured to columns of the structure.

Other aspects of the disclosure will become apparent upon a reading and understanding of the following detailed description.

BRIEF DESCRIPTION OF THE DRAWINGS

The disclosure may take form in various components and arrangements of components, and in various steps and arrangements of steps. The drawings are for purposes of illustrating the preferred embodiments and are not construed as limiting the disclosure.

DETAILED DESCRIPTION OF THE PREFERRED EMBODIMENTS

Figure 2:
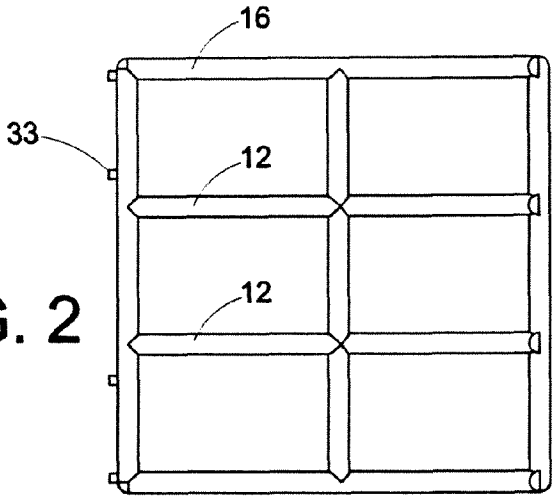
FIG. 2 is a top plan view of the shelter frame of FIG. 1.
Figure 4:
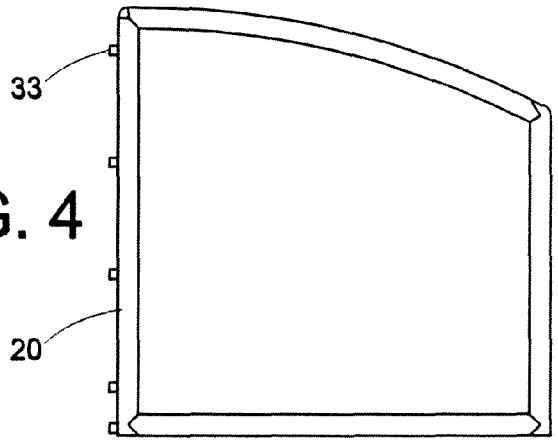
FIG. 4 is a side elevational view of the shelter frame of FIG. 1.
Figure 1:
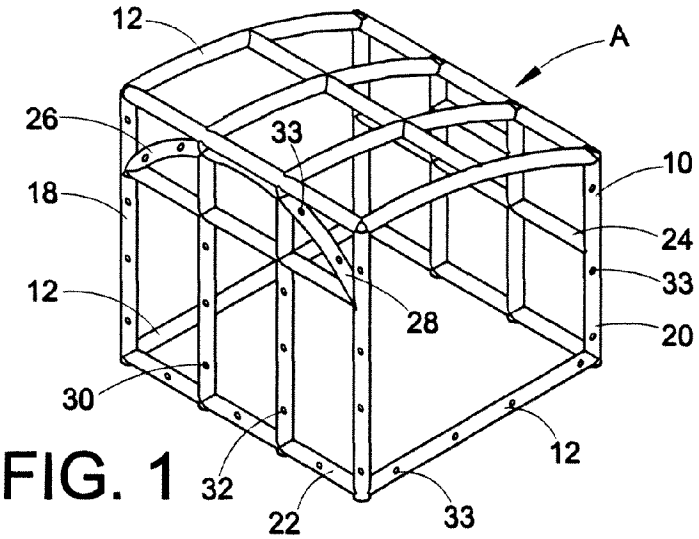
FIG. 1 is a perspective view of a shelter frame with an arched roof in accordance with one aspect of the disclosure.
Figure 3:
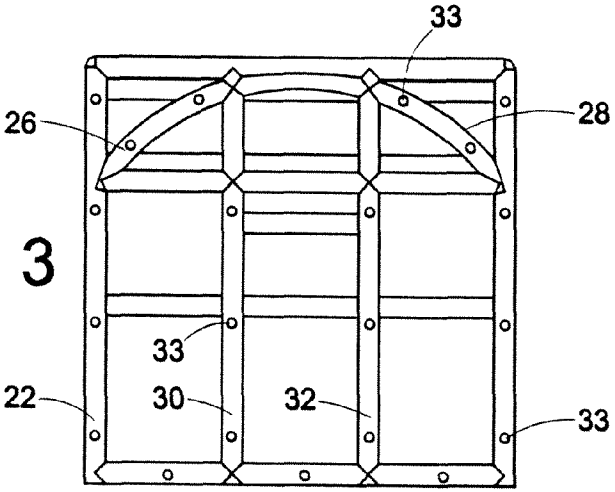
FIG. 3 is a front elevational view of the shelter frame of FIG. 1.

The disclosure relates to temporary or permanent structures for providing shelter. In particular, it relates to a shelter frame which utilizes foam, air, gas, water or any other appropriate filling media for providing insulation and rigidity and is durable and easily assembled or disassembled.

If the structure is deemed for use as a short-term, disposable shelter, the frame can be fabricated from many different materials such as high density polyethylene, polyvinyl chloride (PVC), plastic or any other suitable material types. The material can be thin sheets such as 2 mil thickness to 6 mil thickness (i.e. 002 to 0.006 inches thick), or any suitable thickness or shape.

If the structure is intended to be used for a long-term application, such as about two years or more, than a longer lasting material such as vinyl-coated polyester or nylon cloth or any other suitable material such as similar to that used in children's bouncing jumpers can be used.

Referring now to FIGS. 1-4, shelter A may include a frame assembly 10 formed by a plurality of fill containment structures 12 (such as bars or tubes) which are formed of plastic such as thermoplastic, polyethylene, PVC, or any plastic similar to that used for inflatable rafts or thicker plastic such as that used for tarps. The plastic can be of various thicknesses and can be flexible or rigid. The tubes or pipes themselves are preferably hollow and form a trough or channel which may be filled with water, concrete, air, gas, or fill material such as polyurethane (PU) expandable foam but not limited to same. Alternatively, the tubes can be of a rigid sufficient thickness of plastic and do not need to be filled with foam or water or any other filling material.

Water within the tubes or pipes may be used for insulation purposes or as a water supply for supplying water to inhabitants of the structure such as for cooking, cleaning or bathing purposes. The water may also be carbon filtered in the tubes. Alternatively, the troughs or channels of the tubes 12 may be used for housing electrical wires for providing electricity to the shelter for lighting, heating, cooling, etc. The chambers may be baffled or isolated from each other, or any combination where fill material (such as foam or liquid)

can pass between chambers or not. Foam may be used in a cold environment to provide insulation, and water may be used in hot environments for insulation, for example. Foam may be used to fill seam joints to provide a seal or bond between adjacent fill containment structures. Adhesives, glue or other sealants or bonding agents may also be used. Alternatively, straps, flaps or Velcro® or any other suitable fastening means may be used.

The shelter may be easily disassembled or reassembled by releasing the seam joint (e.g., Velcro®) seal or bonding material and reapplying the seam joint or bonding material. The shelter may be shredded for easy disposal or used as blown insulation which may be reusable and thus is an environmentally "green" product.

Figure 35:
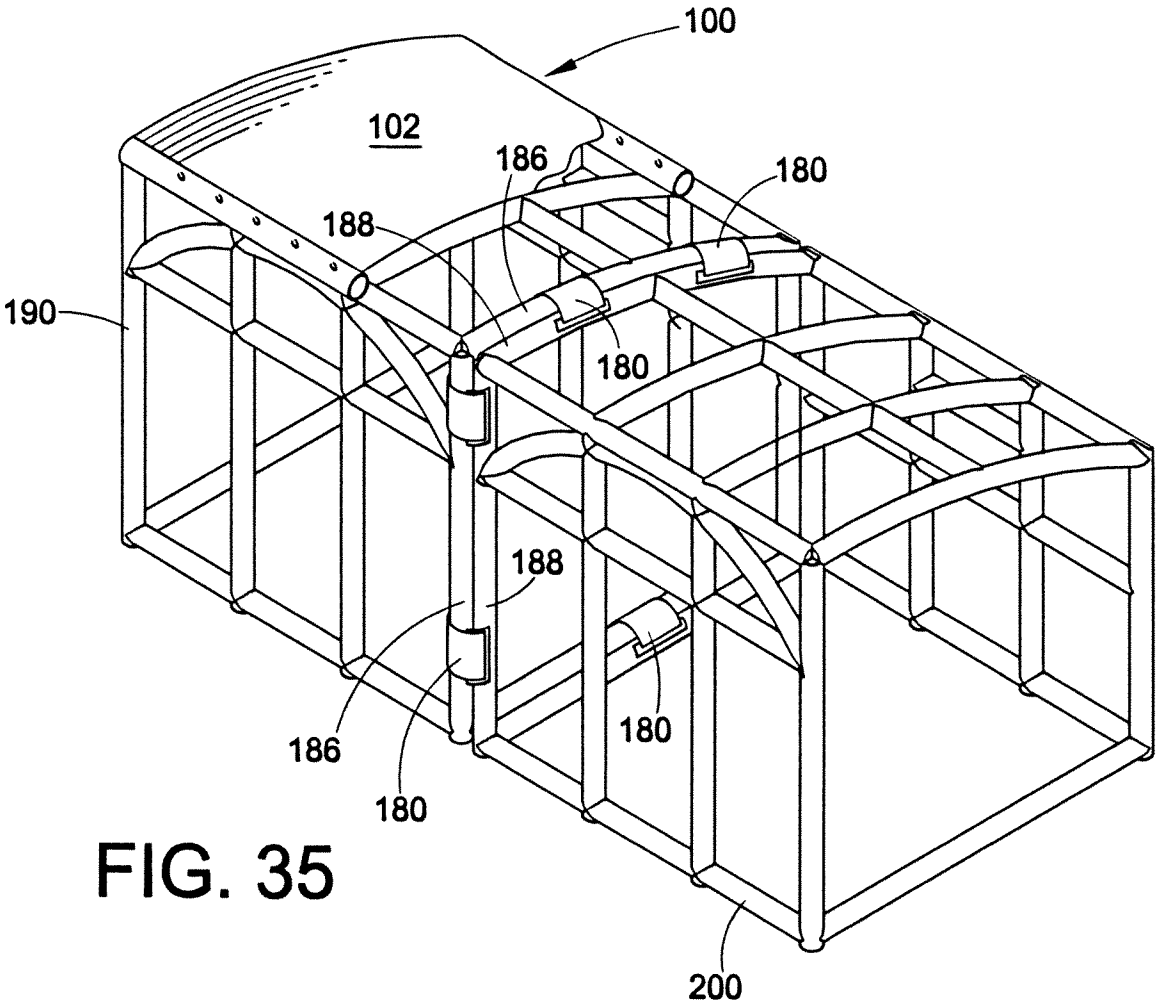
FIG. 35 is a perspective view of two support frame assemblies connected together via sealing joints with a panel from FIG. 18 forming a portion of the roof.

Referring still to FIGS. 1-4, the frame bars 12 are preferably assembled in a rectangular- or square-shaped structure or any preferred shape or configuration, with multiple fill containment structures such as tubes or pipes forming a roof or top wall 16, side walls 18, 20 and a front wall 22 and a back wall 24. The structure in FIGS. 1-4 is shown to have an arched roof. The front wall has several curved tubes 26, 28 which serve to provide additional rigidity to the structure. A door may be formed in front wall 22 between tubes 30, 32. Windows may also be formed between adjacent bars 12. Side wall 18 or 20 may be removable or cut or otherwise configured to receive an attachable structure similar to structure 10, such as shown in FIG. 35 to form a modular arrangement. Fill valves 33 may be formed in each of the tubes for adding foam, gas, or any other fill material to the chambers formed within the tubes.

Figure 37:
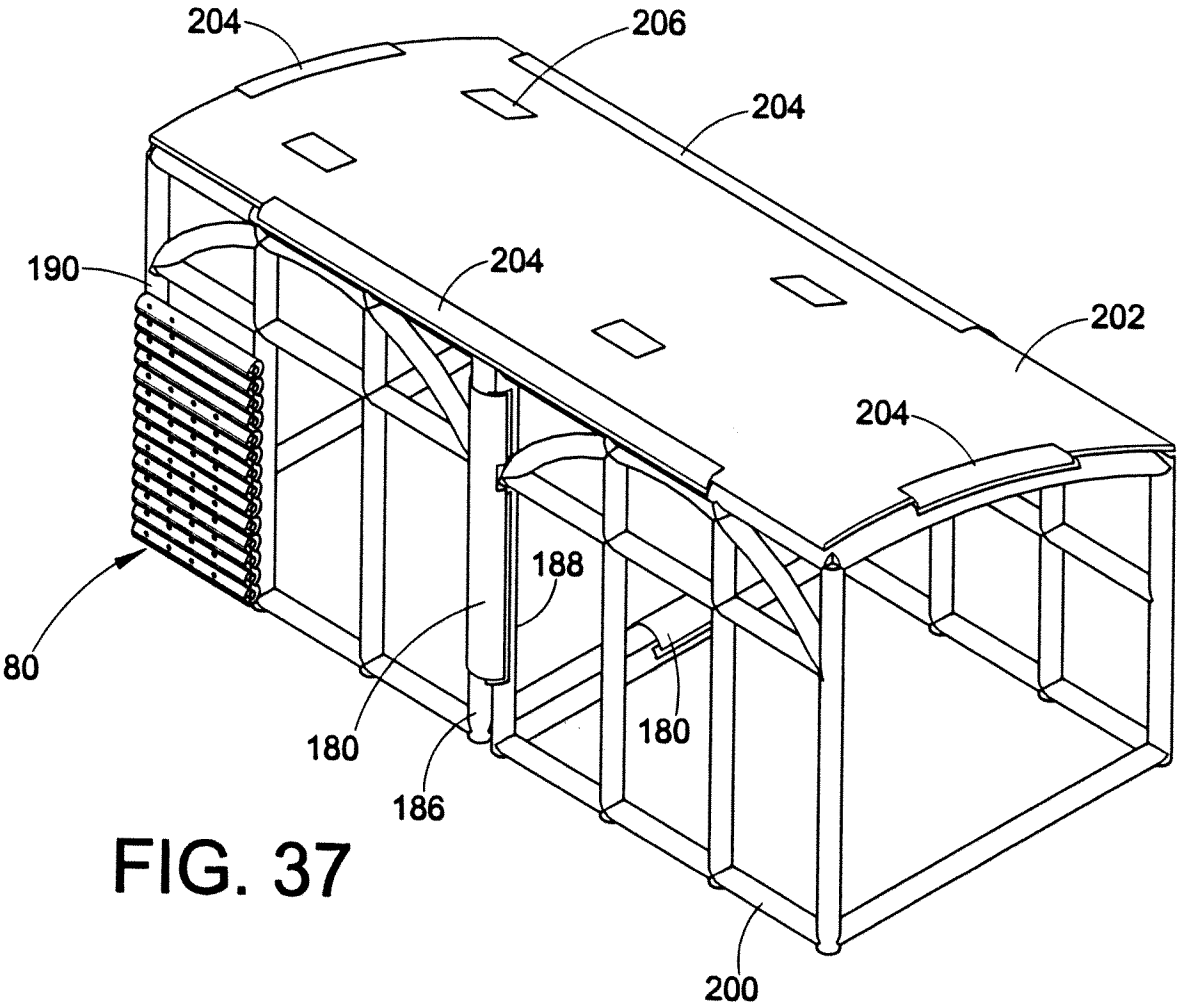
FIG. 37 is a perspective view of a cover secured to a support frame structure by fastening members and illustrating solar panels on a roof and a wall formed by a panel shown in FIG. 12.

The tubes in the roof may be used to accommodate electrical raceways. Stand alone solar cells may be placed over the tubes or as cells 206 printed on the surface of the shelter (see FIG. 37) for providing heat or energy for the structure. A roof, wall or formed material, such as a sheet of plastic, or a tarp may be secured to the top wall by Velcro® or any other suitable fastening means such as glue, stitching, or welding or a combination thereof, such as shown in FIG. 37. Other fastening means include fusing plastic to the tubes, welding, gluing, taping, stitching or bonding to the fill containment structures (FIGS. 5-20) or any combination or variation thereof. The arch support tubes provide rigidity which translates to the outer support tubes.

Figure 5:
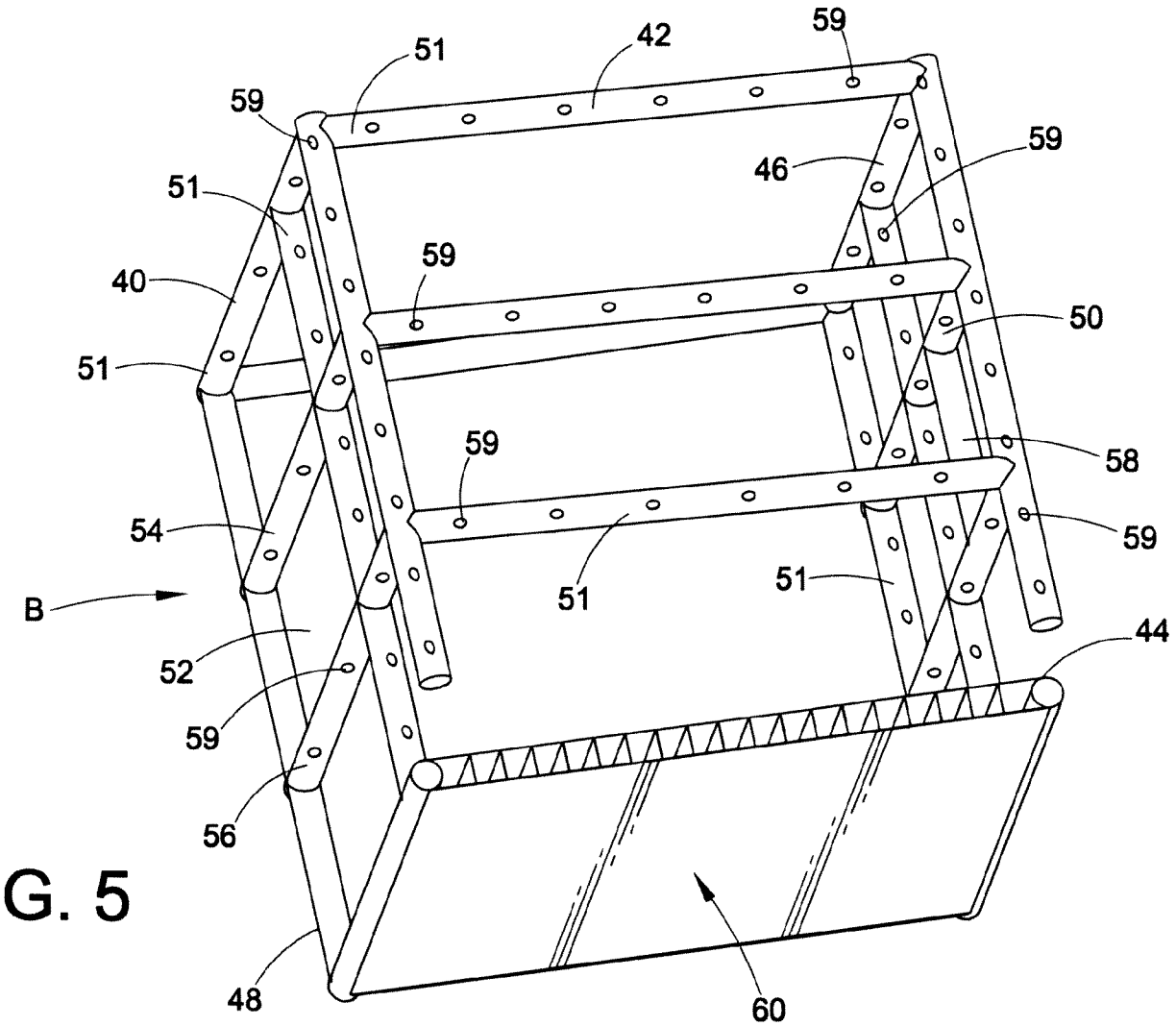
FIG. 5 is a perspective view of a shelter frame having a flat roof in accordance with another aspect of the disclosure.

As an alternative to the arched roof shelter, a flat roof shelter frame B is shown in FIG. 5. The flat roof shelter frame 40 includes a flat roof wall 42, side walls 44, 46, a front wall 48 and a back wall 50 formed by a plurality of tubes or bars 51. A door opening 52 can be formed between tubes 54, 56 in front wall 48. Window openings 58 can be formed on any of the side walls. Fill valves 59 can be formed in each of the tubes for adding support fill (such as gas, water, foam) to the chambers formed within the tubes.

Figure 6:
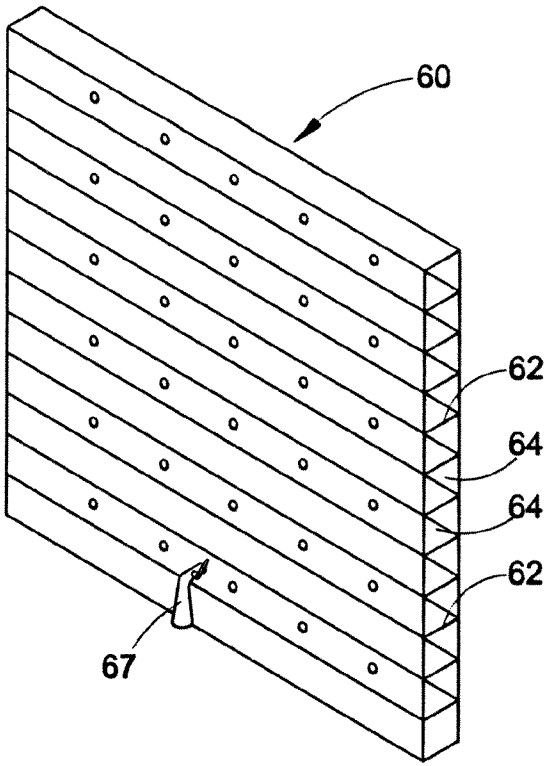
FIG. 6 is a perspective view of a center wall section with ribbed supports for the shelter frame.
Figure 8:
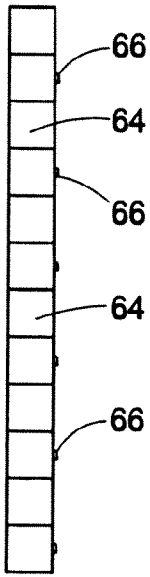
FIG. 8 is a side elevational view of the center wall section of FIG. 6.
Figure 7:
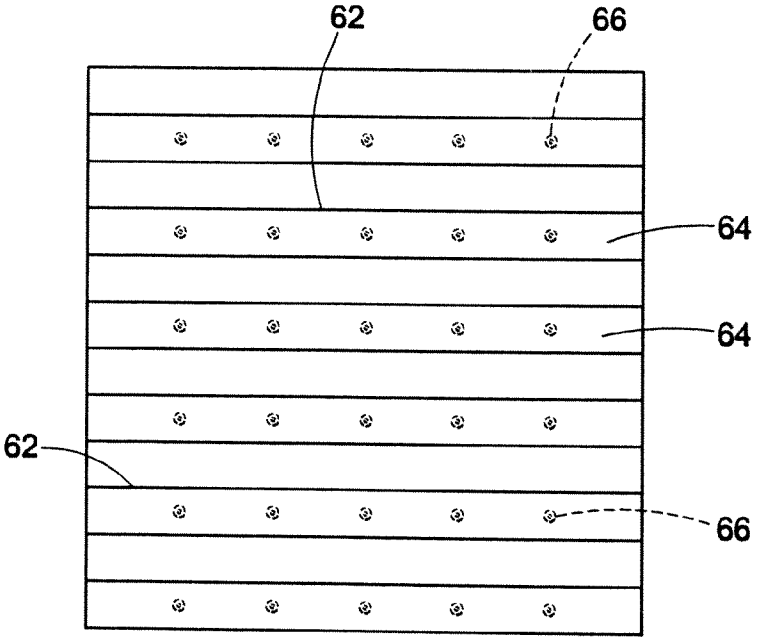
FIG. 7 is a front elevational view of the center wall section of FIG. 6.

A side wall of the frame is shown in cross section to illustrate a ribbed center panel 60, which is described in more detail in FIGS. 6-8. Various types of center wall sections can be used with the frame which will be discussed below. The center wall sections can be secured to the frame by any suitable fastening means such as Velcro® or by fusing, stitching, strapping or bonding at contact points along the length of the wall sections as discussed below.

Referring now to FIGS. 6-8, a first embodiment of a ribbed center panel 60 is shown. The panel is secured to one of the walls of the frame structures. The panel has a plurality of ribbed stiffeners or louvers 62 which are preferably parallel and equally spaced apart along the length and height of the panel. However, the panels do not have to be equally spaced apart. Foam or support fill or water or gas or air chambers 64 are formed between adjacent stiffeners or louvers. The chambers can be separated from each other by the stiffeners or louvers, or they can be perforated or have openings in the stiffeners or louvers so that adjacent chambers can be interconnected. The stiffeners and louvers can be unequally spaced apart as well.

Fill valves 66 are positioned along the length of each chamber 64 to fill the chamber completely with foam, or water. By filling the channels with foam or water, the panel becomes insulated and forms a thermal barrier. Furthermore, the panel has additional rigidity and stiffness and additional structural strengths as a result of adding the support fill media (such as foam or water or liquid) and maintains its shape. Alternatively, the chambers can alternate between air or gas chambers and foam chambers or between water or liquid chambers and air or gas chambers or between foam chambers and water chambers, or any other combination of chambers as needed. A faucet on spigot 67 can be added to any of the chambers 64 to allow for draining of water from the chamber for use in cooking, cleaning, bathing, etc.

Figure 9:
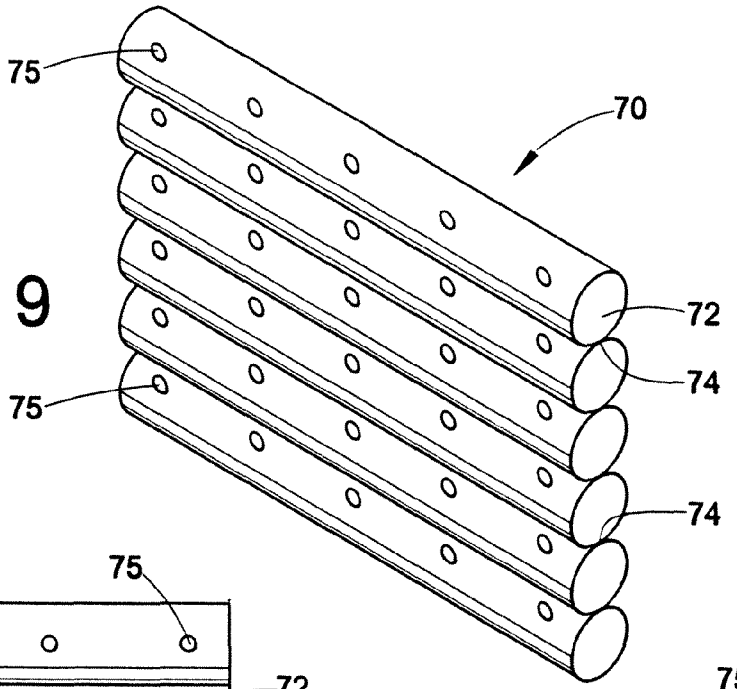
FIG. 9 is a perspective view of a center wall section with pivot joints.
Figure 10:
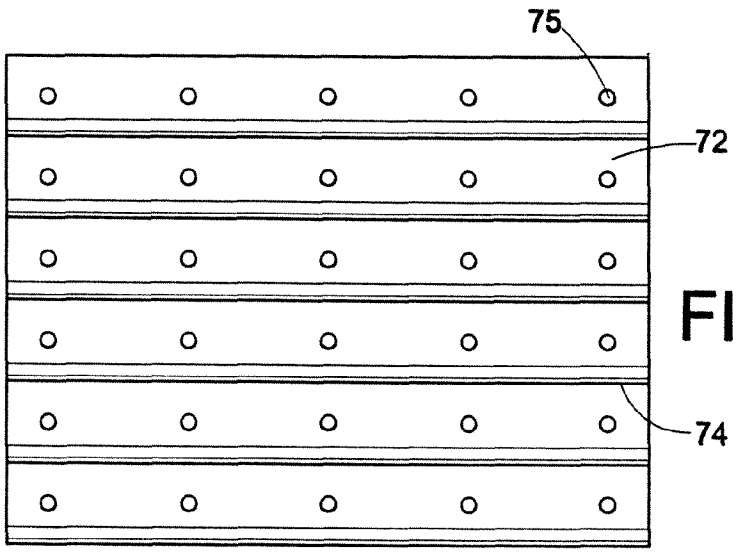
FIG. 10 is a front elevational view of the center wall section of FIG. 9.
Figure 11:
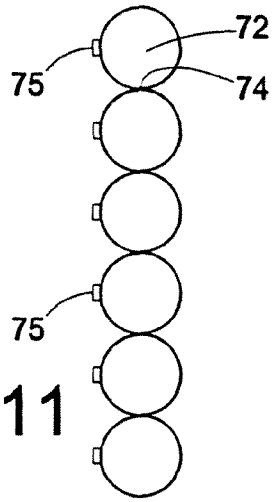
FIG. 11 is a side elevational view of the center wall section of FIG. 9.

Referring now to FIGS. 9-11, a center wall section 70 with pivot joints is shown. Foam or fill media filled chambers 72 are connected by pivot joints 74. Each foam chamber can be substantially or completely filled with foam to increase its rigidity and stiffness. Fill valves 75 may be used in each of the tubes for adding foam, air, gas or water to each of the tube's chambers.

Figure 12:
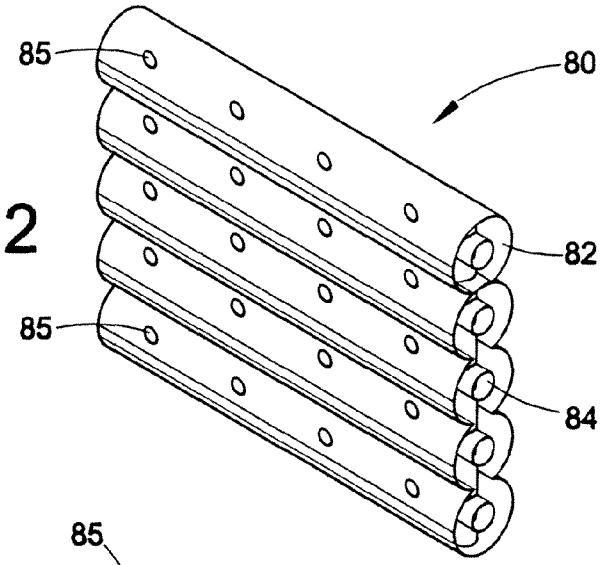
FIG. 12 is a perspective view of a center wall section with center air chambers in accordance with another aspect of the disclosure.
Figure 13:
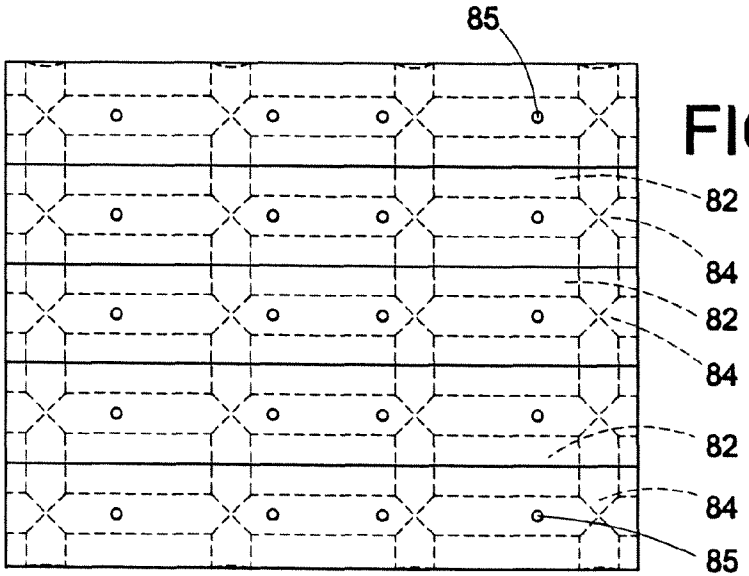
FIG. 13 is a front elevational view of the center wall section of FIG. 12.
Figure 14:
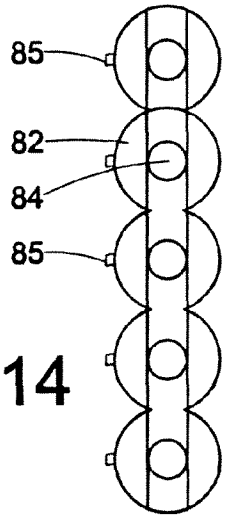
FIG. 14 is a side elevational view of the center wall section of FIG. 12.

Referring now to FIGS. 12-14, another alternate of a center wall section 80 is shown. This wall section has a plurality of tubular foam filled chambers 82 which surround tubular central air or gas filled chambers 84 which are inflated with gas, such as air, and then the foam chambers are filled with foam using one of the methods described in this disclosure. Fill valves 85 can be used in each of the fill containment structures for adding fill media to each of the tube's chambers.

Figure 15:
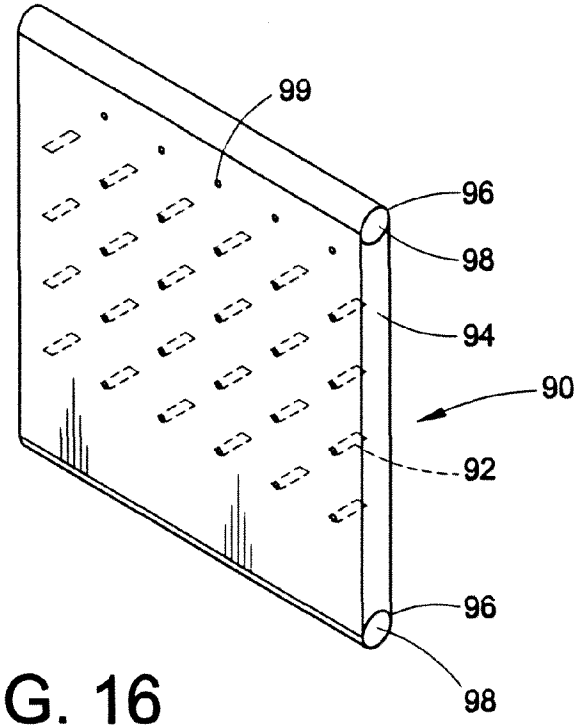
FIG. 15 is a perspective view of a center wall section with quilted supports in accordance with another aspect of the disclosure.
Figure 17:
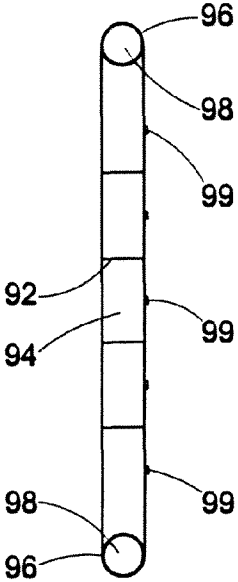
FIG. 17 is a side elevational view of the center wall section of FIG. 15.
Figure 16:
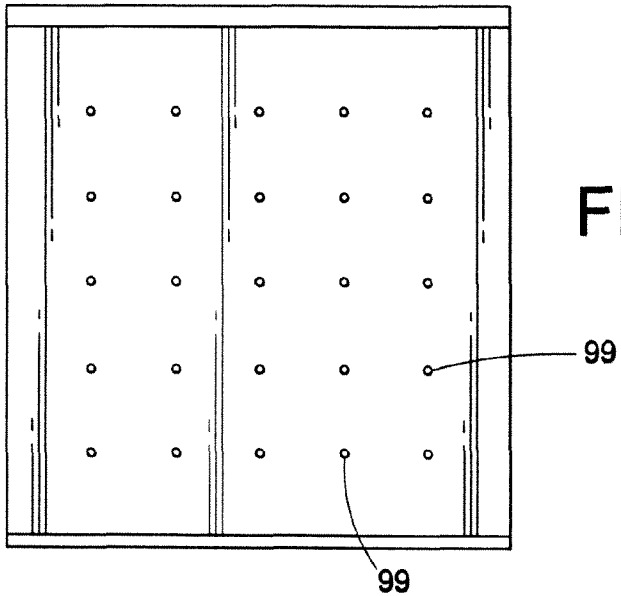
FIG. 16 is a front elevational view of the center wall section of FIG. 15.

Referring now to FIGS. 15-17, another central wall section 90 is shown. Wall section 90 has quilted supports or stiffeners 92 which are staggered along a length of the wall section and also can extend the length of the wall sections. The supports or stiffeners can be parallel and equally spaced apart but are not limited to the configuration. Foam chambers 94 are formed between the stiffeners 92. Support columns 96 are positioned on opposite ends of the wall section and also have foam chambers 98 formed therein. A plurality of fill valves 99 are positioned along a length of each foam chamber for injecting foam or Kaocrete® or any other suitable castable or expandable material into the chambers. A single center wall section can be used to form a wall of the shelter, or multiple center wall sections can be used.

Figure 18:
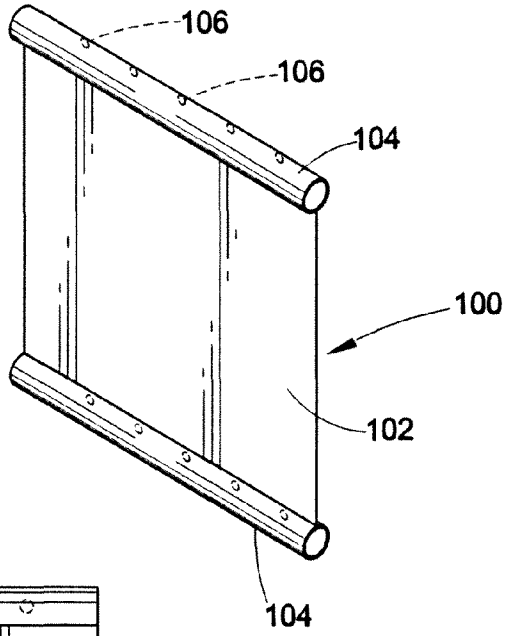
FIG. 18 is a perspective view of a center wall section with panel supports in accordance with another aspect of the disclosure.
Figure 20:
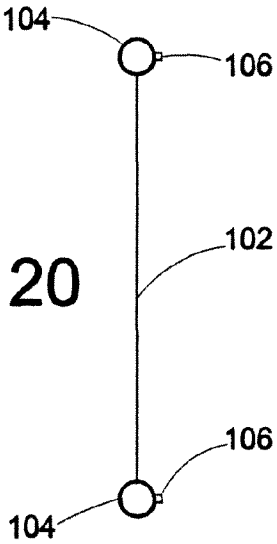
FIG. 20 is a side elevational view of the center wall section of FIG. 18.
Figure 19:
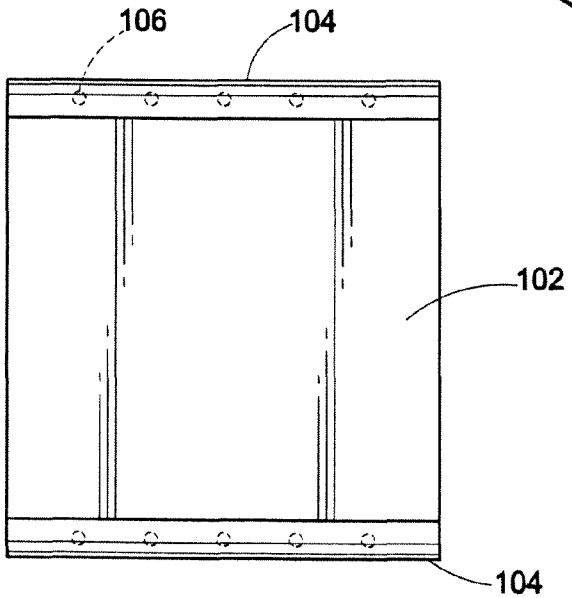
FIG. 19 is a front elevational view of the center wall section of FIG. 18.

Referring now to FIGS. 18-20, another alternative center wall section 100 is shown. The center wall section 100 has a single layer panel or stiffener 102 formed between two tubular foam (or other material) chambers 104 at opposite ends of the panel. A plurality of fill valves 106 are provided along the lengths of the chambers 104 to fill the chambers 104 completely with foam.

Figure 21:
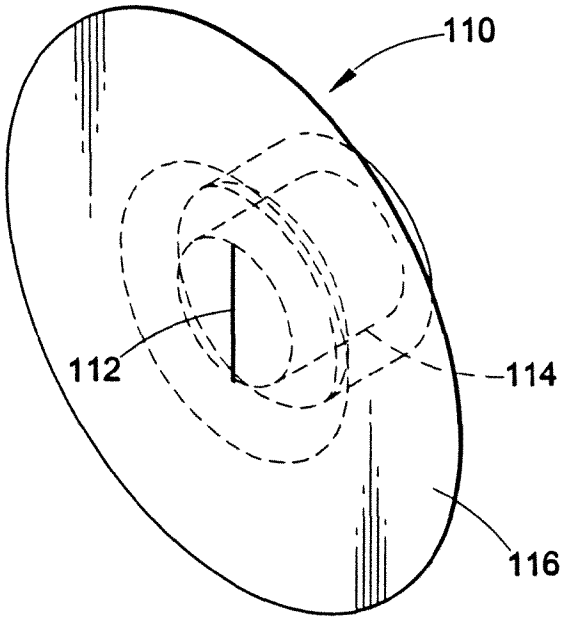
FIG. 21 is a perspective view of a flexible fill valve for a fill chamber in accordance with another aspect of the disclosure.
Figure 22:
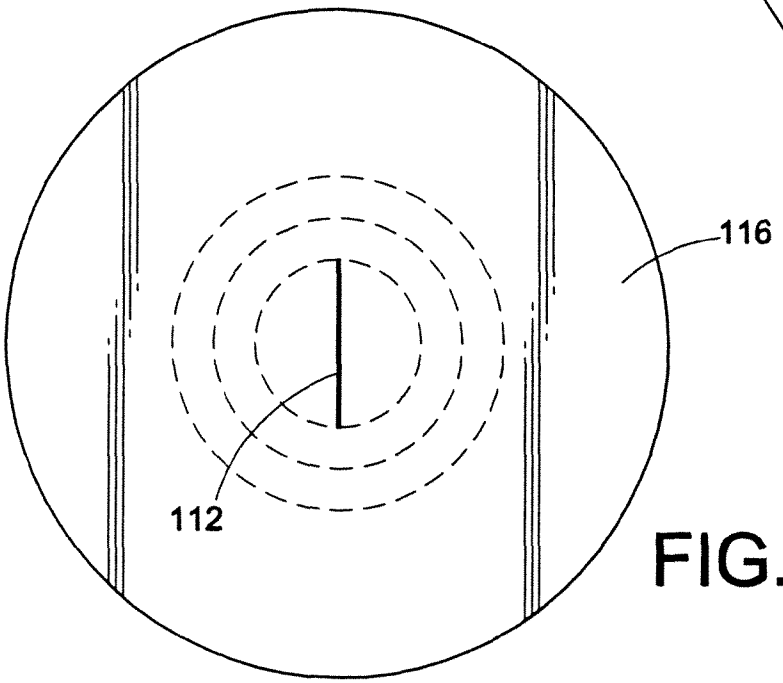
FIG. 22 is a front elevational view of the fill valve of FIG. 21.
Figure 23:
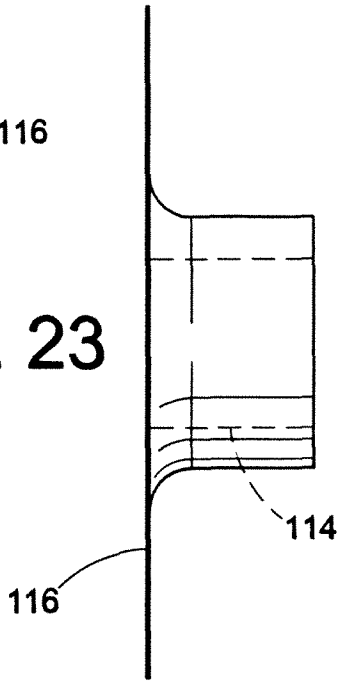
FIG. 23 is a side elevational view of the fill valve of FIG. 21.

Referring now to FIGS. 21-23, a flexible seal sealing valve 110 has a fill valve slot or slit 112 made of rigid or flexible plastic, or elastomer, or any suitable material, a flexible lip seal 114 and a bonding flange lip 116. The fill valve slot 112 is shown on a vertical slit in the flange. Other slits (horizontal, angled, tapered, etc.) may also be used or a flapper or other valving means. The flange lip 116 has a bonding surface for bonding the valve to a center wall section and/or frame, bar, or any chamber that needs filled.

Figure 24:
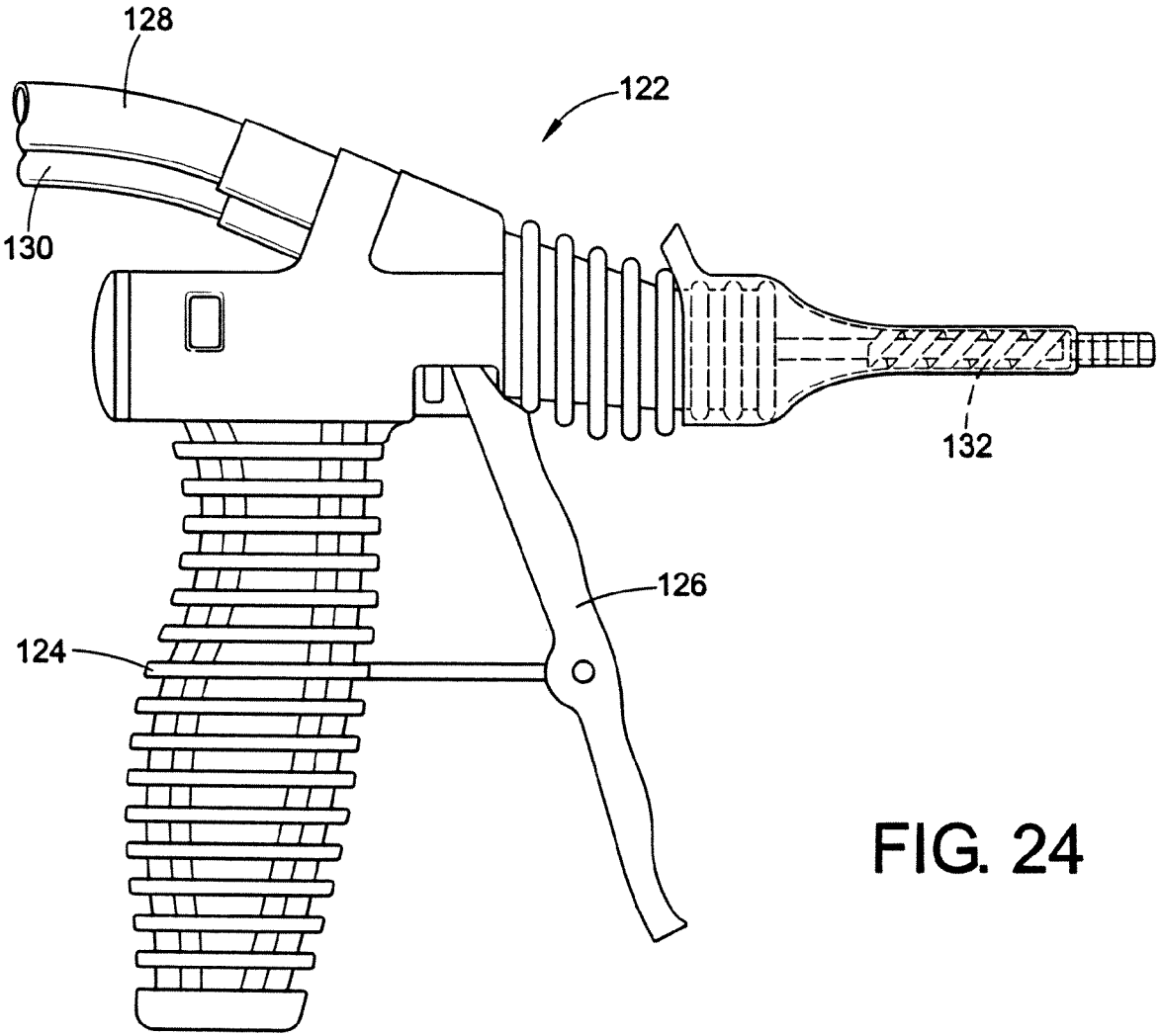
FIG. 24 is a side elevational view of a foam filling gun in accordance with another aspect of the disclosure.
Figure 25:
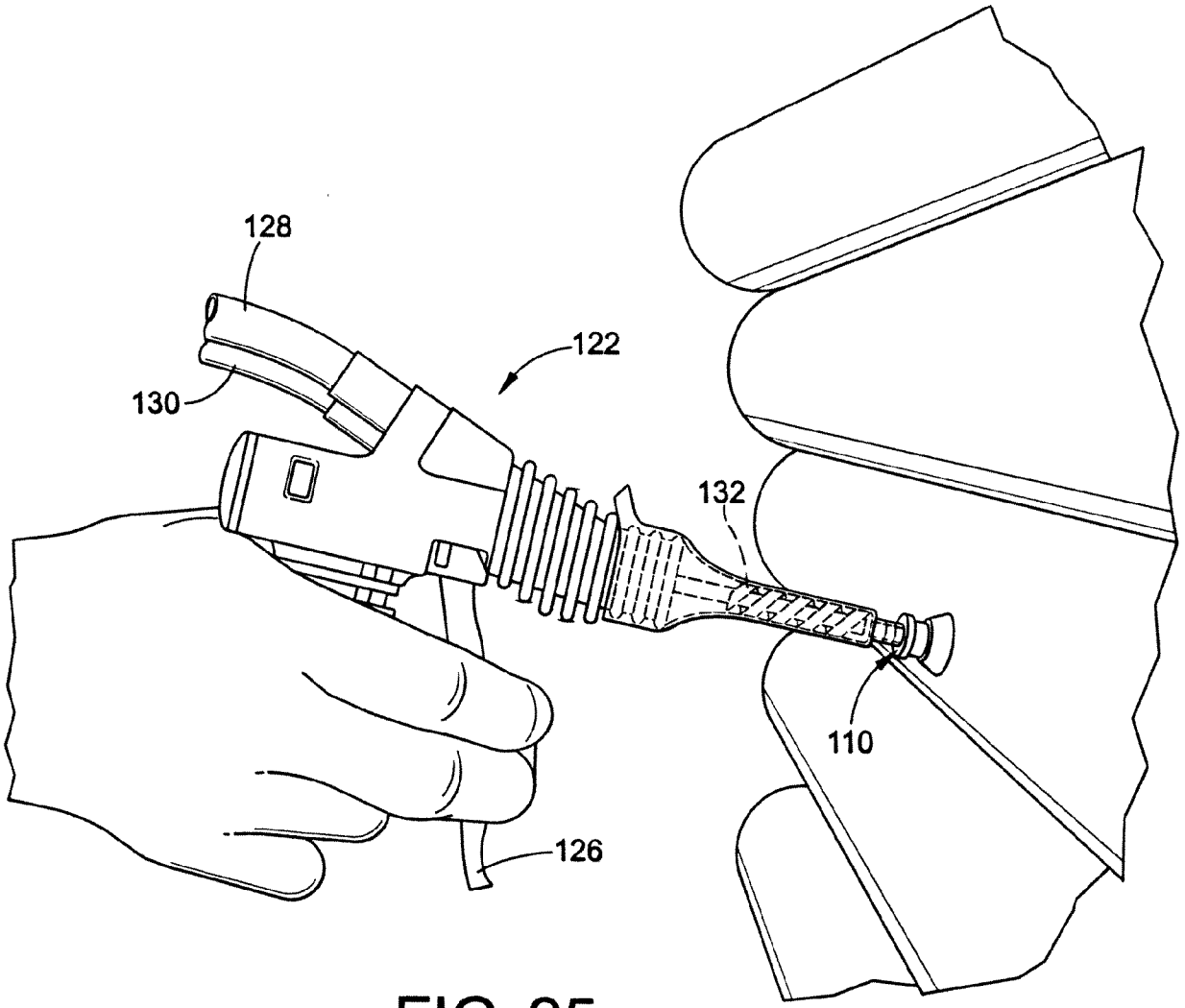
FIG. 25 is a side elevational view of a foam filling gun filling a foam tube of the disclosure.

A foam filling gun shown in FIGS. 24-25 has a nozzle which is inserted into and past the fill valve slot or slit. The flexible lip seal 114 surrounds and seals the valve and gun nozzle.

Referring now to FIGS. 24 and 25, a foam filling gun 122 has a nozzle, a handle 124, a squeeze trigger 126 and two flow tubes 128, 130 for receiving the two-part foam chemicals (commonly called "A-B foam" or "2K foam").

The nozzle 122 has a corkscrew style auger 132 formed within the nozzle which is used to mix the two parts of the foam mixture together, and then the foam is injected through valve 110 into the center wall sections. The gun may be attached to a timer to control the amount of foam injected into one of the fill valves. The proper amount of foam is injected to avoid air or gas voids from forming or being trapped in the foam chambers. For cold environments a heating element may be attached to the gun to heat the foam material before it is injected into the foam chamber. Accordingly, fill valves are preferably placed about every two or three feet or any suitable spacing to ensure the proper amount of foam is injected in each section of the foam chambers to avoid overfilling or over pressurizing. The foam cures fairly quickly, to allow the user to erect the structure quickly, but the nozzle can only be used once if the foam cures in the nozzle and then is discarded.

The foam to be injected is a fast curing or acting foam which assumes the shape of the chamber within about 30 seconds. The chemistry can be changed or modified to speed up or slow down the curing time. The foam, which can preferably be a closed cell, two-part polyurethane foam which is fast-curing, is fire-resistant, and has a high expansion rate. However, the foam is not limited to these properties.

Figure 26:
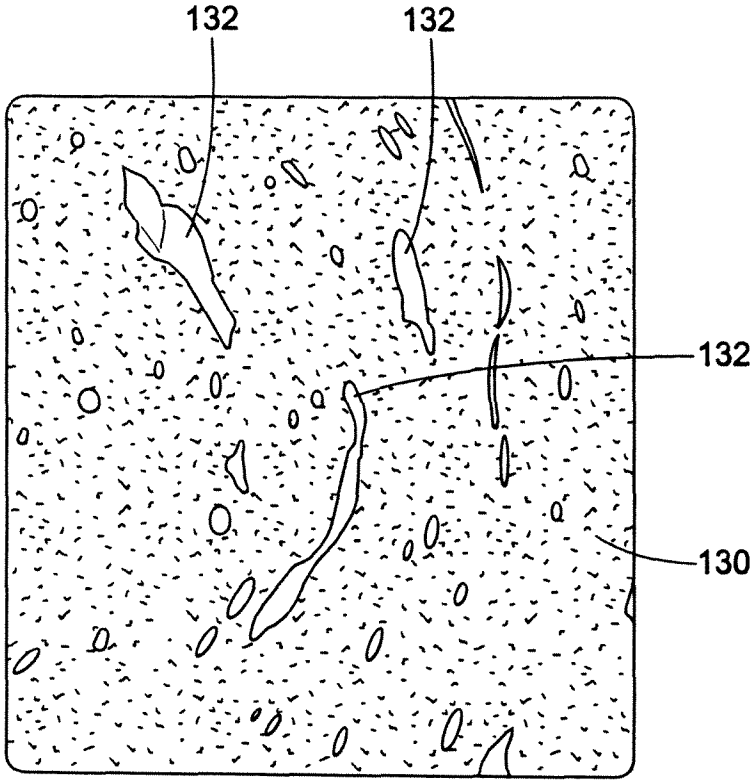
FIG. 26 illustrates a foam having a non-uniform density.
Figure 29:
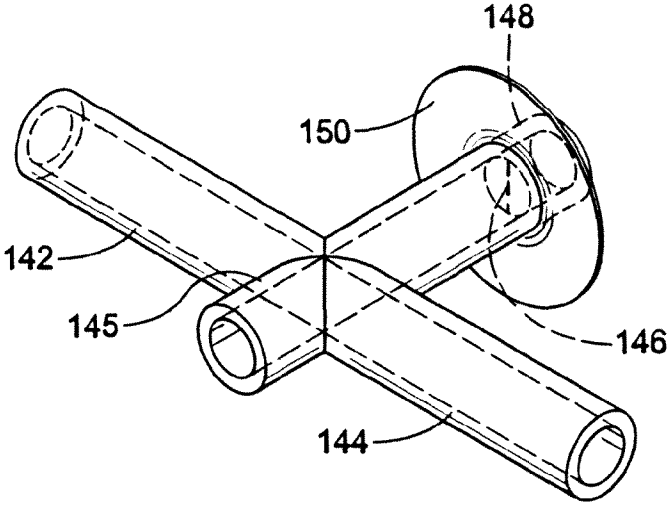
FIG. 29 is a side elevational view of a flexible fill valve with t-shaped extension tubes in accordance with another aspect of the disclosure.
Figure 31:
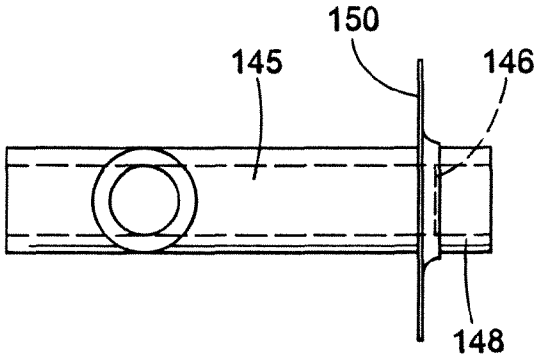
FIG. 31 is a side elevational view of the valve of FIG. 29.

The two-part polyurethane foam (PU) mixture (called an A-B or 2K foam mixture) has a first part and a second part which when mixed together react and produce $CO_2$ which in turn produces foam bubbles. The goal is to mix the foam and inject it completely into the foam chamber to fill every corner and void. An example of foam 130 which is not uniform and has gas voids or "bubbles" 132 is shown in FIG. 26. An object of the disclosure is to avoid producing foam with such air or gas voids. A propellant is used to quickly mix and move the PU foam from compressed storage canisters but not limited to same. The restriction of foam expanding due to space constraints helps limit the forming of air or gas voids. The chambers help control expansion of the foam. The foam contacts a baffle and expands in a certain direction.

Figure 27:
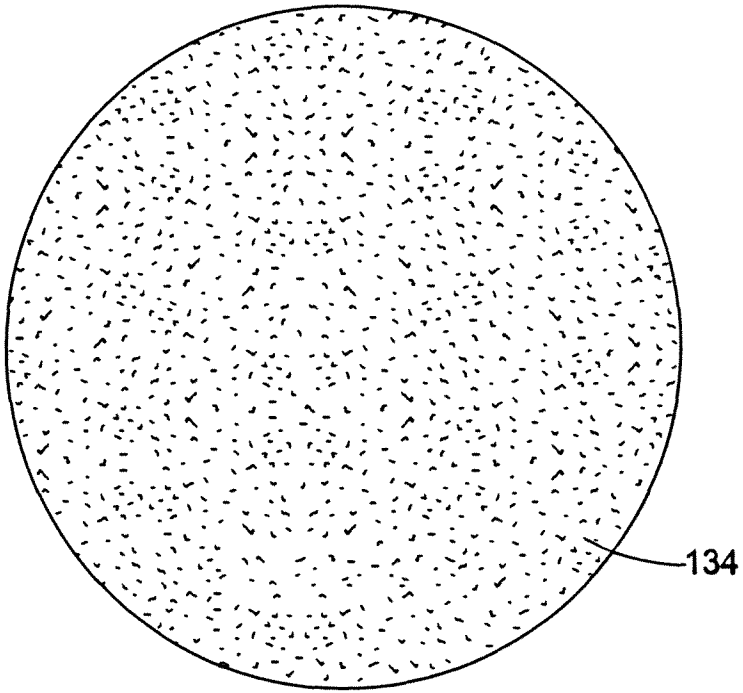
FIG. 27 illustrates a foam having a uniform density in accordance with the disclosure.

An example of uniform foam 134 provided by the disclosure under compression which has very little or minimal air voids as shown in FIG. 27. The foam is very dense (such as 25 to 1 density), uniform, and can withhold high compression loads. The foam is used to "inflate" the structure and can also help provide a structure for use in construction applications where concrete is poured in, around or over the structure or in any combination. The foam can also be used to form features of the structure, such as a toilets, sinks, beds, tables, or other desired features.

The foam does not have to be limited to PU foam. Semi-soft foam, such as a sponge foam can be used. Other types of foam (such as used with Kaocrete®, which is a refractory concrete mix) can also be used. Other mixes, such as regular concrete or other materials can also be used.

The foam can be environmentally safe, or "green," and can even have soybean as part of its chemical composition.

The foam can be polyurethane foam which is fire resistant and expands under pressure and produces carbon dioxide which makes the foam self-inflating.

Referring now to FIGS. 28-31, a flexible fill valve 140 with extension foam tubes 142, 144, 145 or a substantially "t-shaped" valve is shown. This valve allows a nozzle to spray in different directions such as along a longitudinal or transverse axis when it is inserted into the valve to uniformly fill the chambers with foam. The valve has a fill valve slot 146, a flexible lip seal 148 and a bonding flange lip 150. The extension foam tubes 142, 144 extend away from each other in opposite directions but not limited to same. Extension tube 145 extends perpendicular to tubes 142, 144 but not limited to same.

Figure 28:
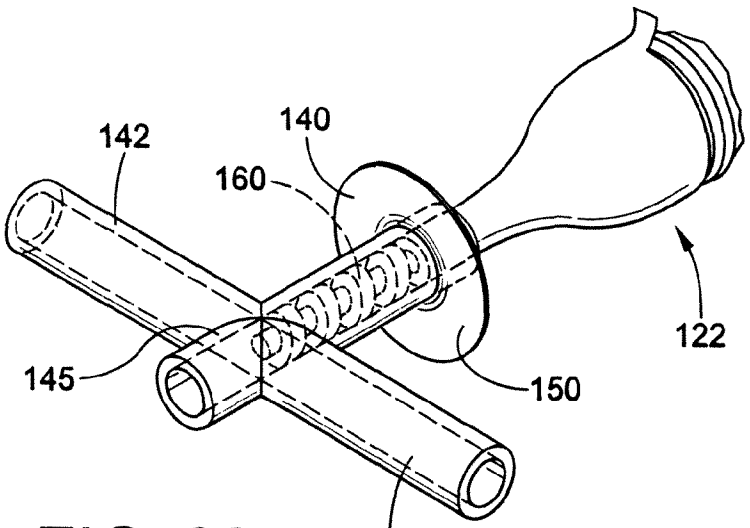
FIG. 28 is a perspective view of a flexible fill valve with t-shaped extension tubes and a mixing auger disposed within the valve and a foam filling gun extending therefrom in accordance with another aspect of the disclosure.
Figure 30:
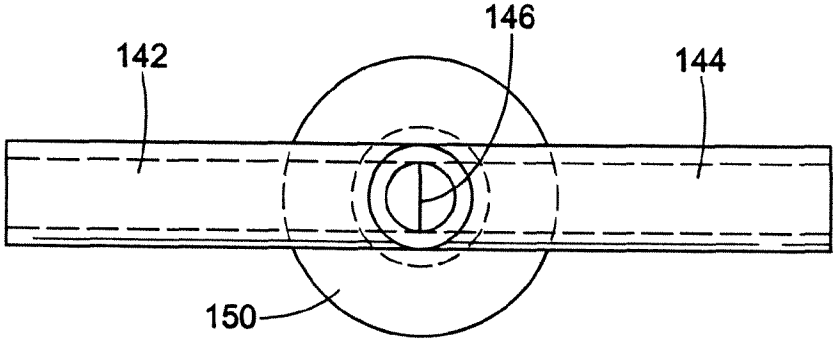
FIG. 30 is a front elevational view of the valve of FIG. 29.

The foam filling gun's nozzle will be inserted into and past the fill valve slot 146 in FIG. 28. The diameter, length or shape of foam extension tubes can vary to change the amount or direction of flow of foam from the foam gun. As the foam is injected, each corner of the foam chamber is filled to avoid or minimize air or gas gaps or voids. The gun is inserted into the fill valve, and the PU tank pressure propels the foam to fill up the chamber's space through each of the extension tubes 142, 144, 145. The foam expands quickly within about 30 seconds. The valve lip seals ensure the foam does not leak out when foam is being dispensed into the chambers. The valves also provide relief for overpressure of gas or foam from the bottom of the structure upwardly.

Referring to FIG. 28, a static mixer or auger 160 can be placed within the valve assembly so that the foam mixture can be mixed within the valve immediately after leaving the gun nozzle. A similar auger assembly can be placed within valve 110 of FIG. 21. The auger mixes the two foam chemical components, A and B, where B acts as a catalyst, which cures or hardens in about 30 seconds. The auger has a corkscrew configuration and can mix the chemicals in opposite directions.

The one-part PU foam is sprayed into a gap in the foam chamber and reacts to moisture of the air slowly and expands and hardens. Two-part PU foam uses a catalyst to speed up the expanding and hardening process to about 30 seconds. The auger mixes the two parts using a corkscrew configuration and spins in opposite directions. By placing the auger in the valve assembly, the gun nozzle does not have to be replaced, since the mixing does not occur in the nozzle. In a dry environment, such as a desert, water can be mixed with the PU to control the curing process. In a cold environment, heat and/or water can be added to the PU to cause different reaction speeds.

If a fill material needs to be de-gassed, such as PU foam for example, additional micro-sized holes can be added on the inside or inboard side of the fill containment structures (that is in the interior of the frame assembly) wherein the holes are small enough to let gas escape but not the actual foam or fill material itself.

Another option is to form fill containment structures from fine woven cloth or non-porous plastic which is perforated to allow gas to exit or escape while the fill material such as PU foam does not escape.

A central tube in the fill containment structure such as central tube 84 in FIGS. 12-14 can have small pinholes added or the tube can be made semi-porous or porous enough to allow the gas to escape through the holes, but not the PU foam or fill media.

Yet another option is to add twine or cloth woven into the PU foam or fill media whereby the gas escapes along the strands of fiber in the foam or fill media, such as in a wicking fashion.

Figure 32:
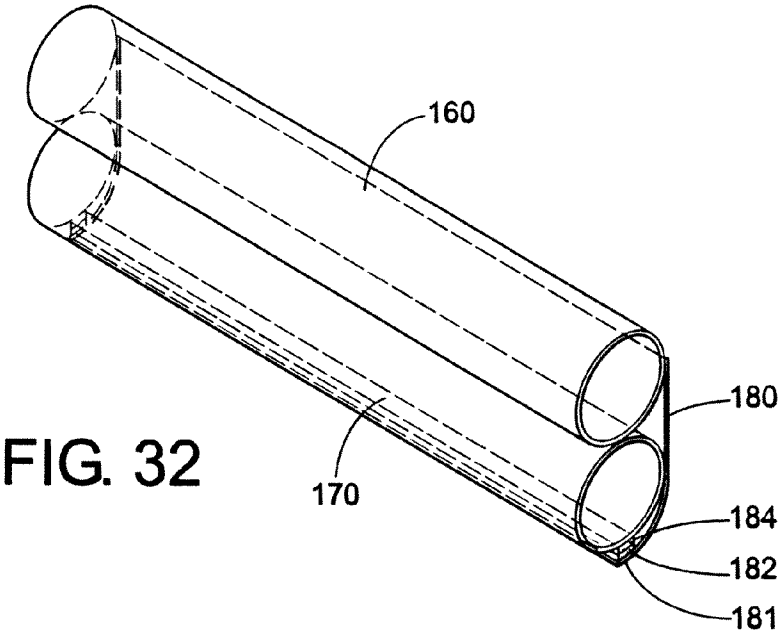
FIG. 32 is a perspective view of foam chamber support frame sections with a sealing joint in accordance with another aspect of the disclosure.
Figure 33:
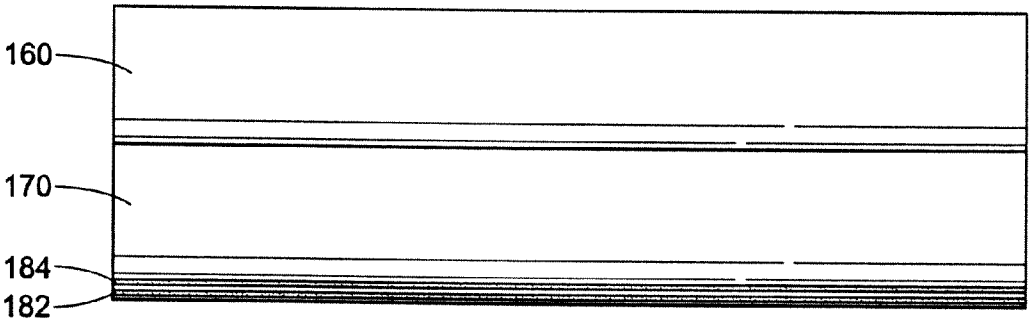
FIG. 33 is a front elevational view of the support frame with sealing joint of FIG. 32.
Figure 34:
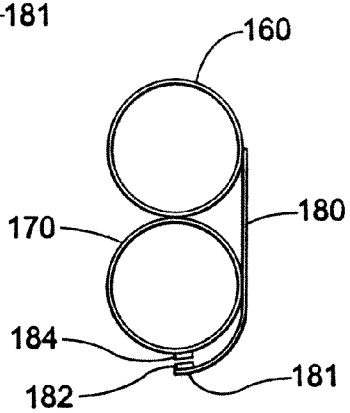
FIG. 34 is a side elevational view of the support frame with sealing joint of FIG. 32.

Referring now to FIGS. 32-34, several structure frame assemblies can be attached or connected together in a modular fashion. A fabric such as plastic or a tarp can be used to span the distance between adjacent frames and is secured by the flexible sealing joint. FIG. 32 shows a first support frame member 160 from a first shelter and a second support frame member 170 from a second shelter.

A flexible sealing and joining flashing or flap 180 with a sealing lip 181 is connected to the first support member 160 and extends across both support frame members 160, 170 and is secured in place on the second support frame member 170 using mating Velcro® pads or strips 182, 184 formed on the flap and the second support member, respectively, as shown in FIGS. 33 and 34. The joining flaps can cover the complete wall to keep unwanted water out, etc.

Referring now to FIG. 35, the flaps 180 are shown as being used in several locations on adjacent support frame members 186, 188 of two adjacent frame assemblies 190, 200 which are connected in a modular fashion. However, any number of flaps and flap lengths may be used to secure the frames together. The flaps can also be used for attaching center wall sections to the frame structure.

Figure 36:
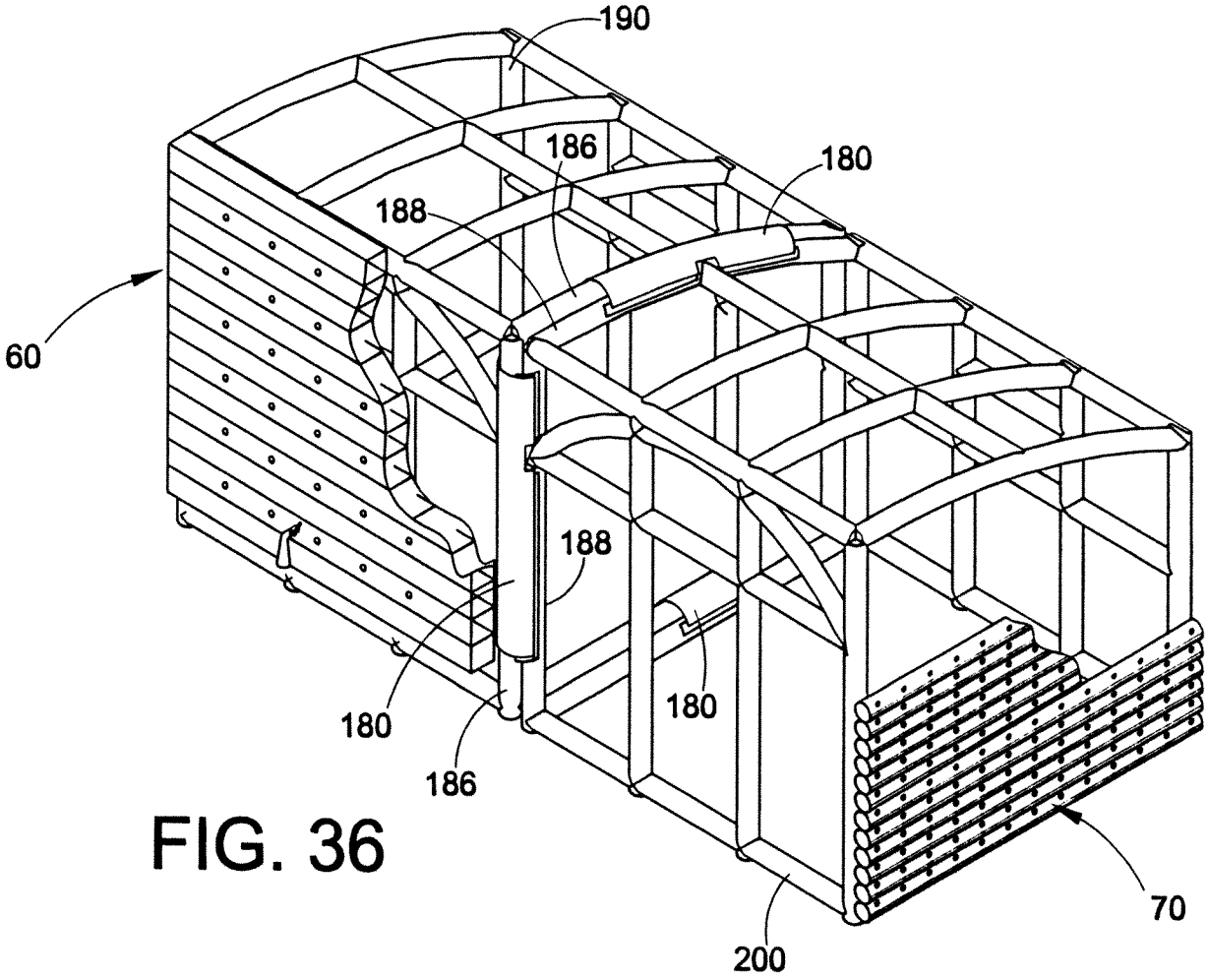
FIG. 36 is a perspective view of two support frame assemblies held together by elongated flaps and illustrating panels shown in FIGS. 6 and 9 forming wall portions.

Referring to FIG. 36, the flaps 180 may extend across a substantial portion of each tube 186, 188 to provide additional rigidity as well as provide a seal between adjacent tubes of adjacent structures.

FIG. 37 shows a tarp or cover 202 which is secured to the top tubes of the frame via Velcro® strips 204 or any other suitable fastening means. The cover provides a shield for the interior of the structure and also seals the structure from water entering the structure from above.

Figure 38:
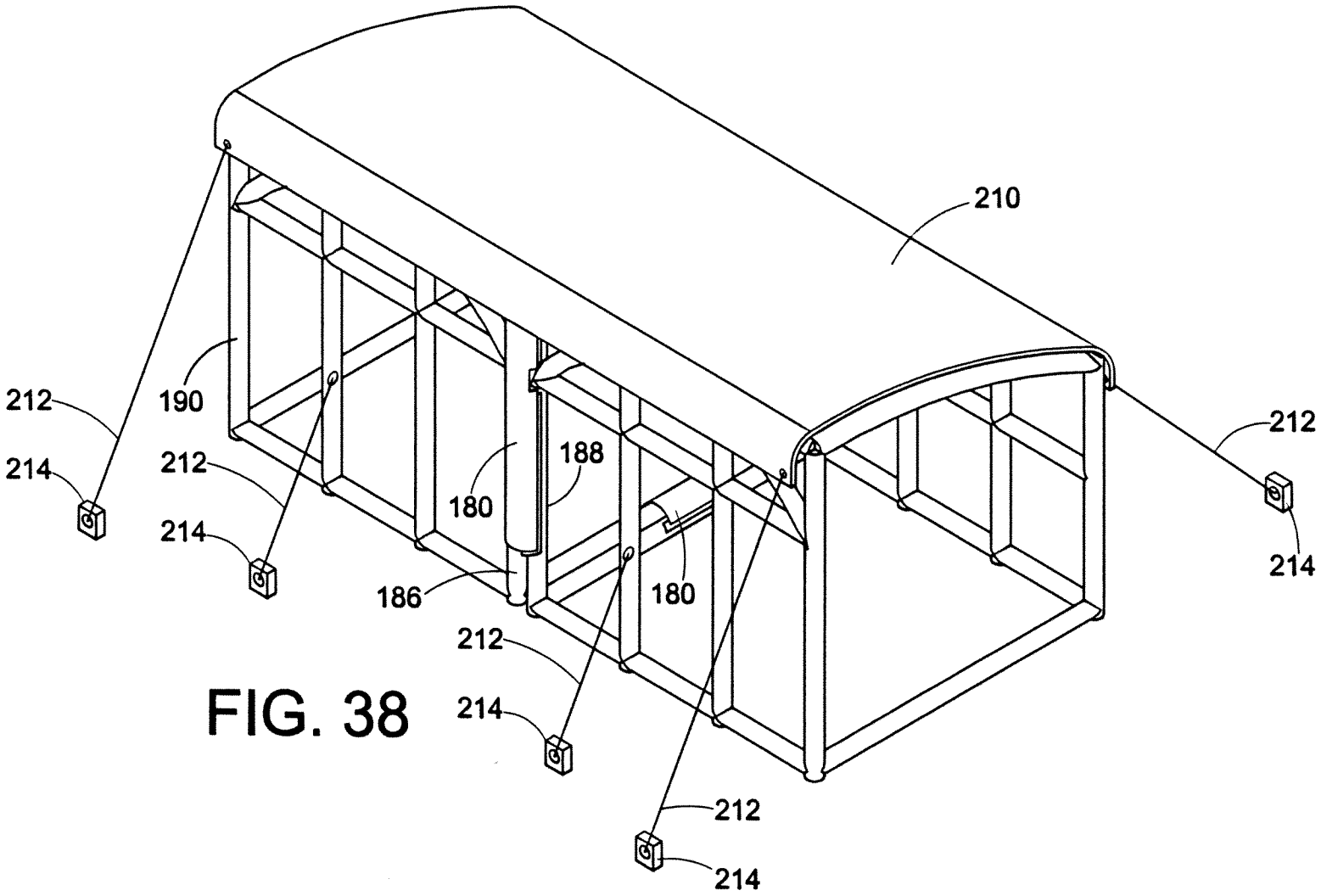
FIG. 38 is a perspective view of a cover held onto a support frame structure by cables and stakes.

Referring to FIG. 38, a tarp or cover 210 can be secured to the roof of the structure via cables 212 and stakes 214 which are secured to the ground. Also, stakes 214 and cables 212 can be used to secure the structure frame itself to the ground.

Referring to FIGS. 35-37, various panels illustrated in FIGS. 6-20 are shown as forming portions of the roof section or side wall or end wall sections. For example, in FIG. 35 the roof panel is shown to be formed by panel 100 of FIG. 18. The entire roof as well as the side and end walls can also be formed by panels 100, or any combination or orientation of panels from FIGS. 6-20 can be used depending on the desired purpose.

Referring to FIG. 36, a side wall is shown to contain panel 60 from FIG. 6, and an end wall is formed by panel 70 of FIG. 9. Again, any combination of these panels, or any panels from FIGS. 6-20 can be used on any frame assembly in any orientation.

Referring to FIG. 37, a panel 80 from FIG. 12 is shown forming part of a side wall. Panels 80 can be used on the entire frame. As mentioned earlier, any combination of panels from FIGS. 6-20 can be used on any frame assembly and in any orientation.

Typically, the structure tubes or center wall sections are filled from the bottom up. Air or gas, is filled into the structure's tubes 12 to form the shape of the structures. Then foam or other material is added from the bottom up. If there is too much pressure, the valve slit opens and pressure is relieved through the valve. The valves and/or internal baffling help ensure the right amount of PU foam is held in the structure.

The structure itself when deflated can be rolled up and stored in a packing container similar to the way a tent is stored. If for whatever reason, additional PU or other foam cannot be added to the structure, such as for cost savings, etc., cable straps or other forms of reinforcement can be used to increase the structural strength and minimize the fill media needed. Straps can be placed in place of horizontal or the arched tubes or any other location. Other materials such as steel, cloth or twine, can be integrated with the walls at various orientations. Fiber can be added to the PU foam for greater rigidity and strength. Other materials can be used to increase the rigidity and strength as well.

A strapping means can be used in conjunction with the structure to secure the structure to the ground or to secure a covering over the structure. For example, eyelets can be added at the bottom of the walls to allow a rope or cable to secure the structure against high winds, gusts, rain, etc. Eyelets can also be placed flush to the ground so stakes can be used adjacent the tubes or walls. Tubes also can have holes for staking directly into the ground.

Referring to FIGS. 39-43, an alternate preferred embodiment of the disclosure is shown. A shelter frame assembly 300 is formed by a roof assembly 302, columns 306 and a plurality of walls 308 removably connected to the roof and columns.

Figure 41:
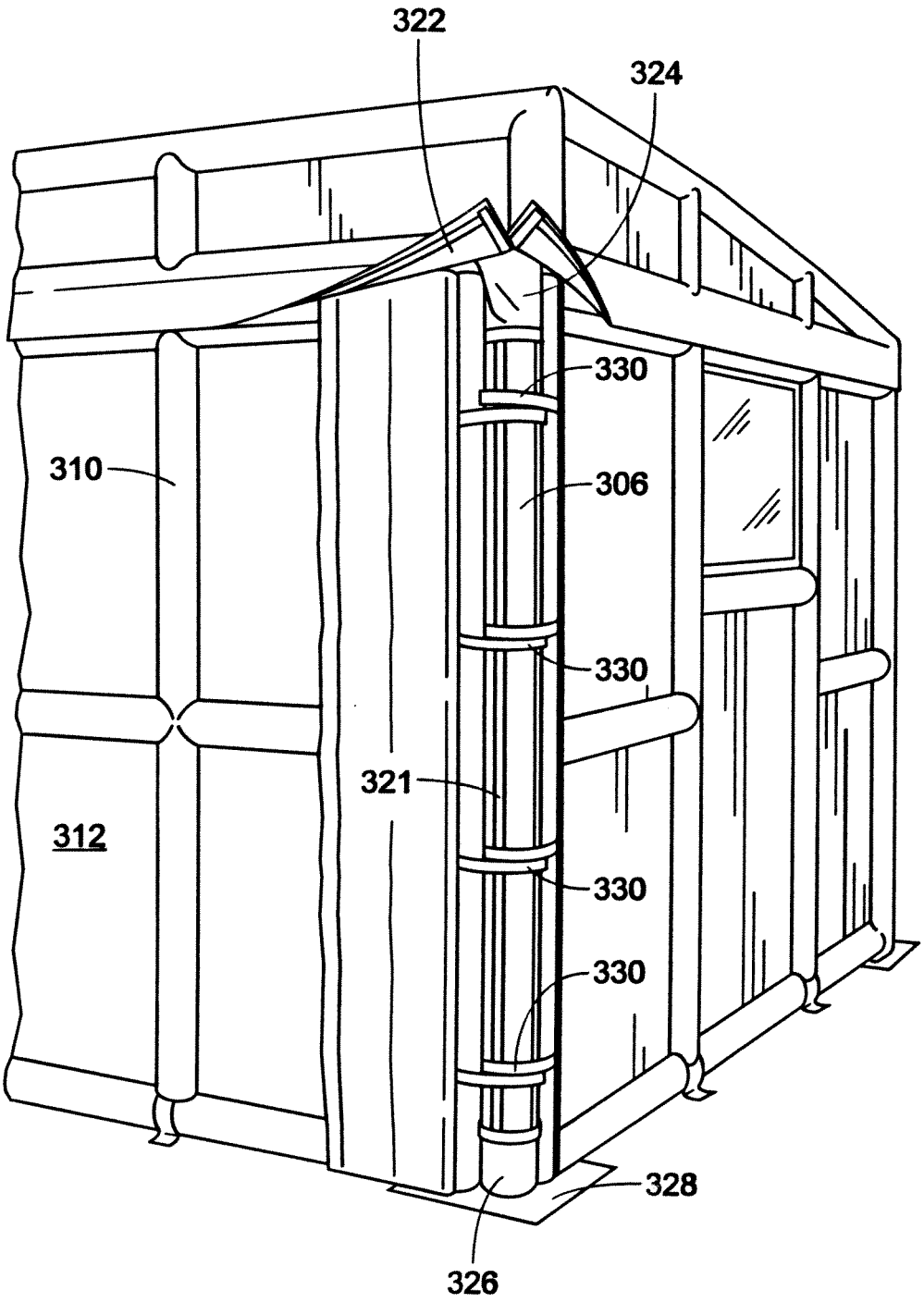
FIG. 41 is a perspective view of a column and straps with flaps removed to expose the column and straps.

The roof assembly includes fillable support members 304 which can be filled with foam, water or any suitable material as previously discussed herein. The roof is installed onto four columns or corner posts 306 by inserting the posts 306 into coupling or connecting members 324 as shown in FIG. 41. Connecting members 324 can be formed of cloth or other material and extend over an upper portion of a column in a covering or sock-like fashion.

Figure 39:
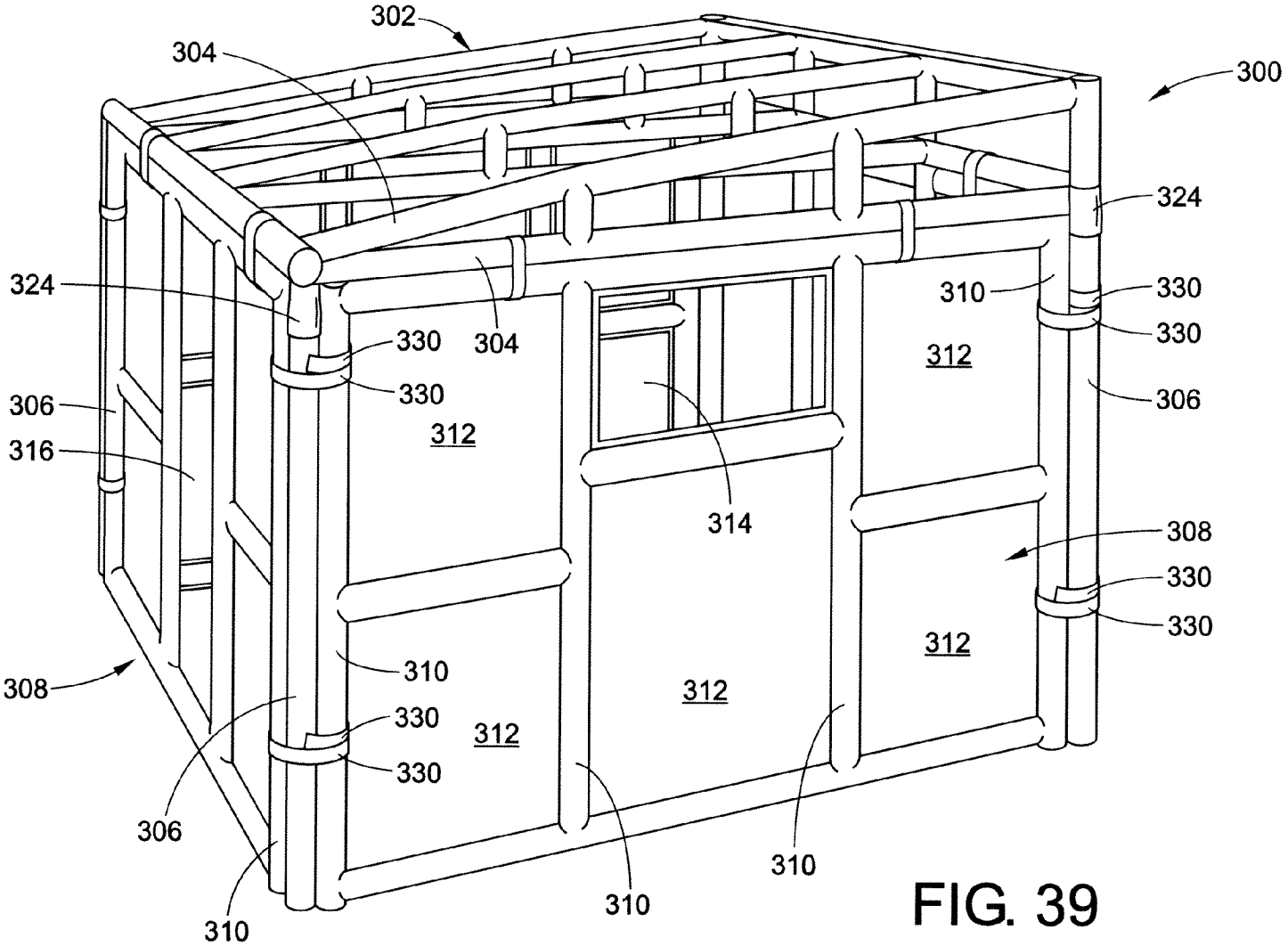
FIG. 39 is a perspective view of a partially assembled support frame assembly with cloth walls in accordance with another aspect of the disclosure.

Once the roof is installed on the columns, walls 308 are installed between adjacent columns as seen in FIGS. 39-43. Walls 308 are formed by a plurality of fillable support members 310 which are filled with foam or water or any suitable material as discussed above. Panels 312 such as made of cloth or any other suitable material are installed between support members 310. Windows 314 and doors 316 can be formed between support members 310 as seen in FIG. 39. The walls can be interchangeable and are replaceable as needed.

Figure 40:
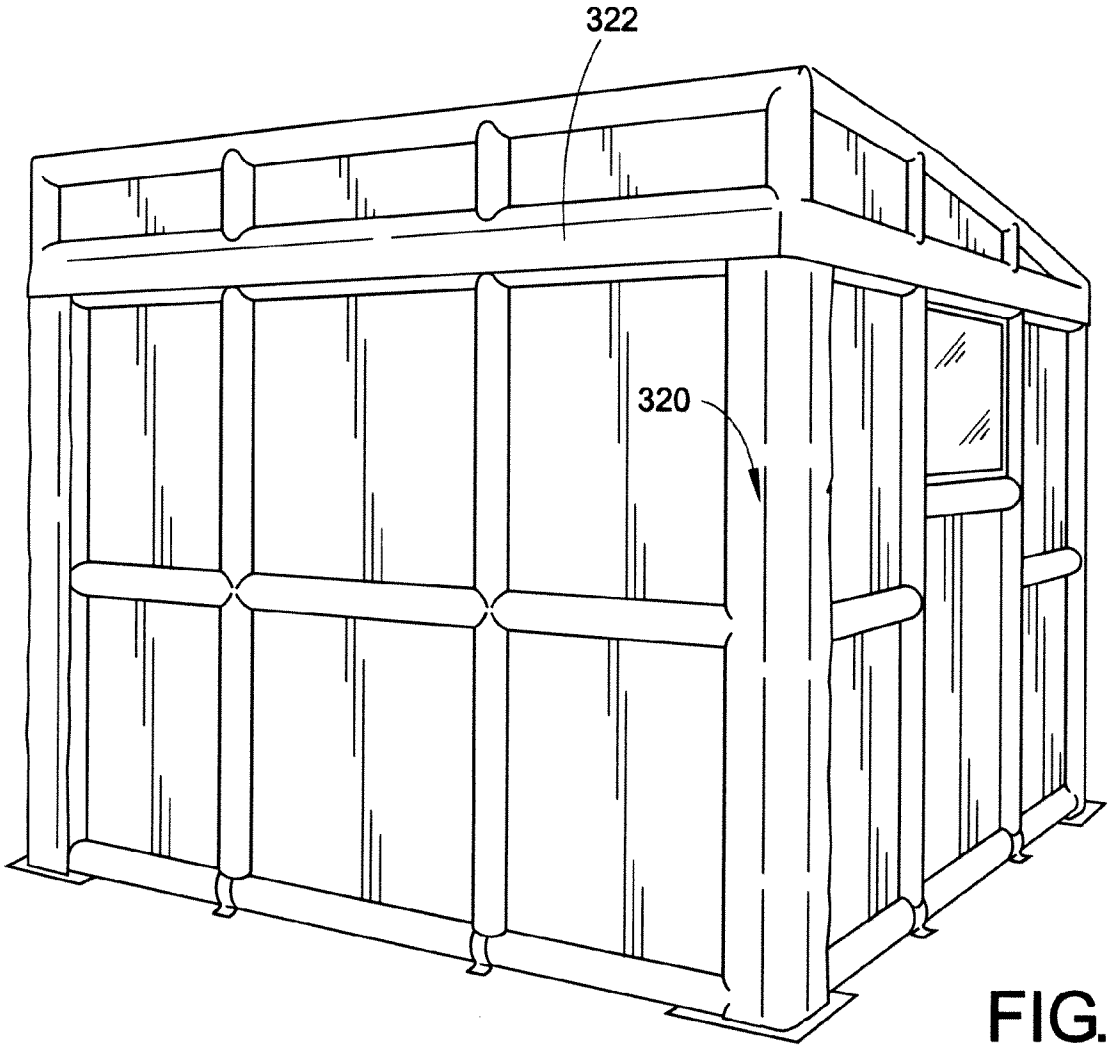
FIG. 40 is a perspective view of an assembled structure of FIG. 39.

Referring now to FIG. 40, flaps 320 made of cloth or other suitable material are folded over the corners of the structure and over the columns 306. The flaps can be covered with Velcro® or hook and loop straps or any other suitable fastening means which securely fasten to corresponding strip 321 on the columns.

Figure 42:
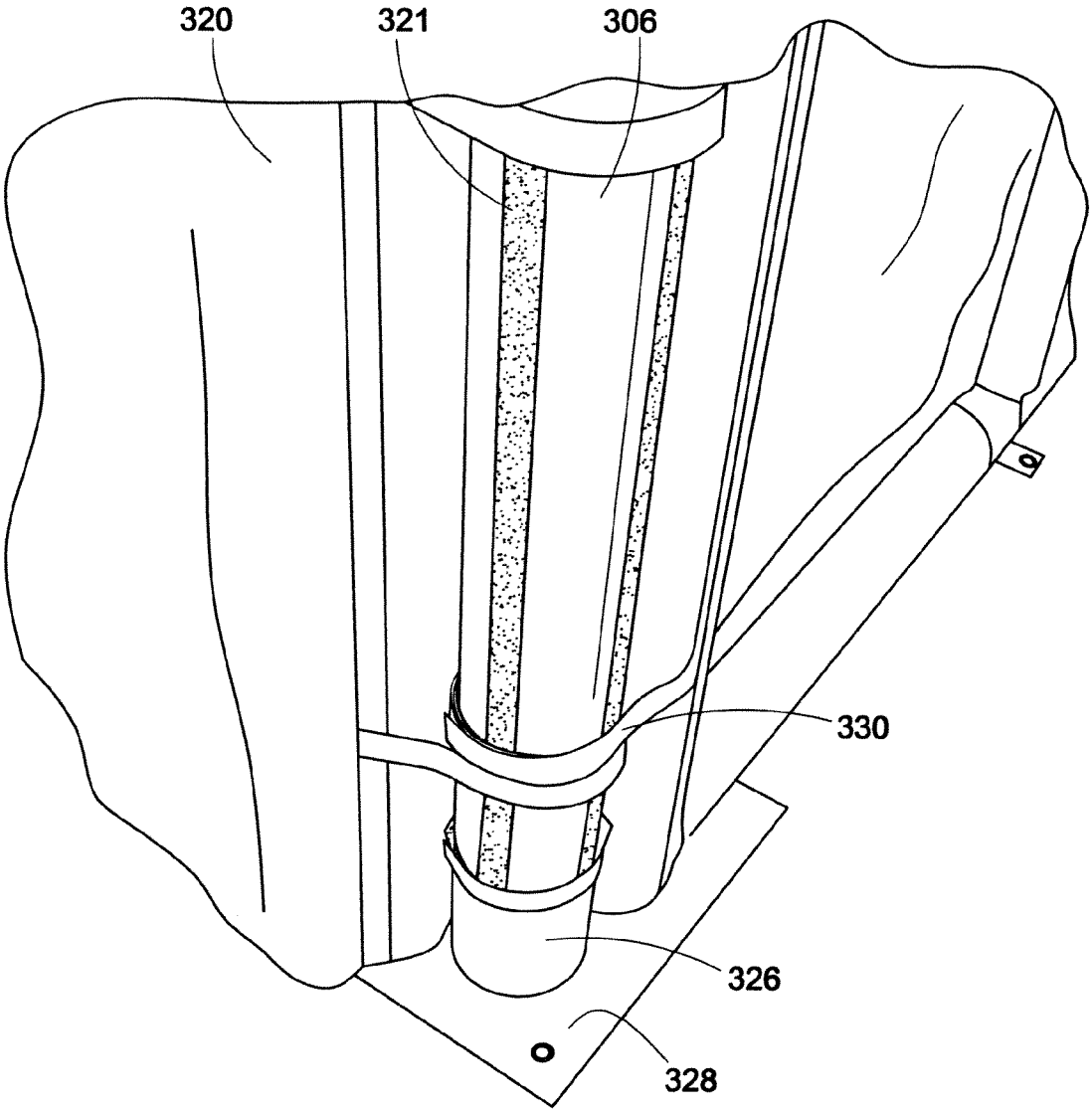
FIG. 42 is an enlarged perspective view of a bottom portion of a column secured to a bottom or floor material.
Figure 43:
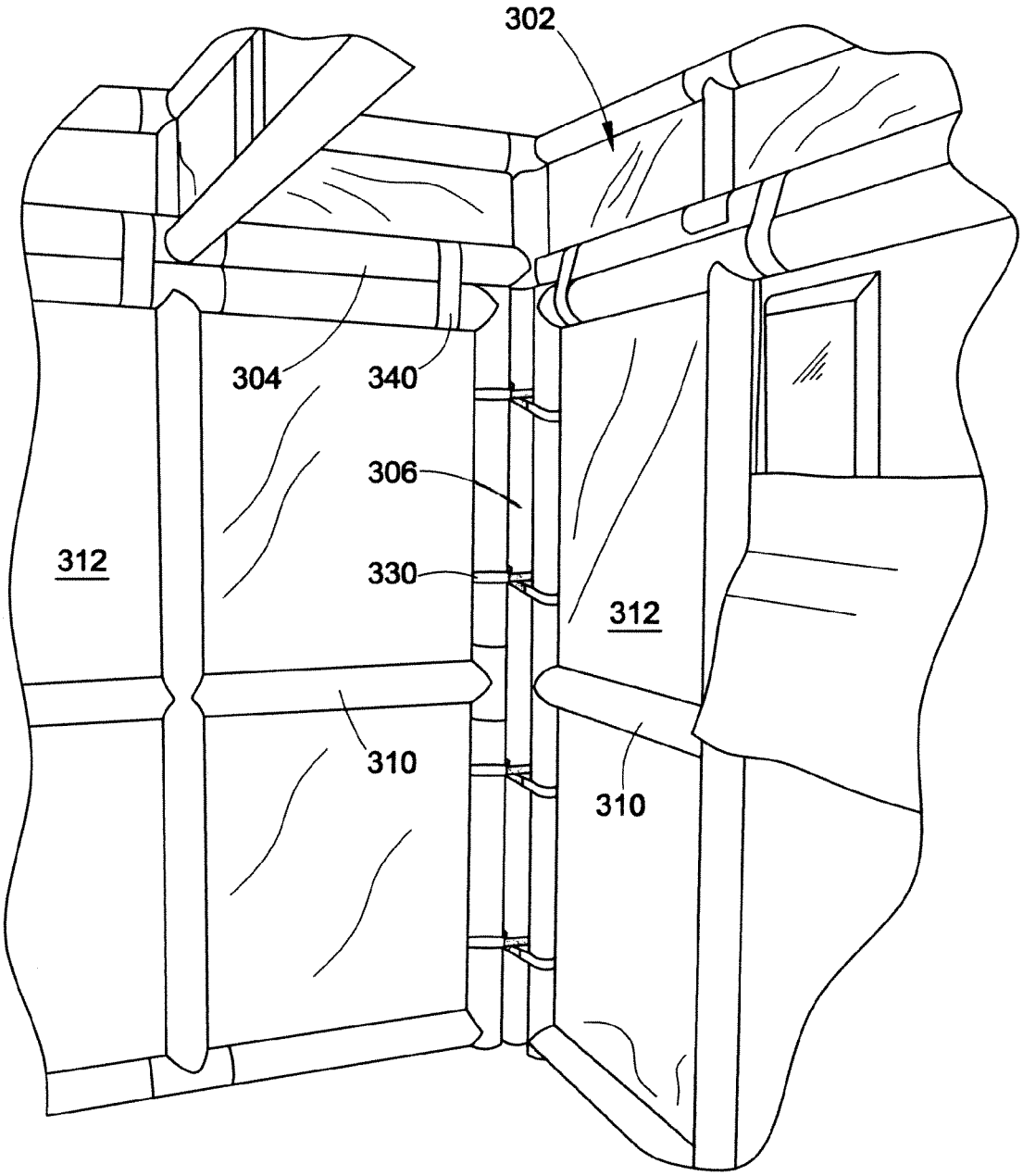
FIG. 43 is a perspective view of inner walls and a column of the structure of FIG. 40.

A coupling member 326 can be formed on a floor panel 328 made of cloth or other suitable material as seen in FIG. 42 which matingly receives a lower portion of the columns.

Straps 330 such as Velcro® straps or any other suitable fastening means such as clips, hooks, buttons, etc. can be attached to support members 310 and/or columns 306 to removably secure the support members 310 and columns 306 together. Flaps 322 are also secured to the roof structure and overlap the support members 304, 310 and columns 306. Straps 340 such as Velcro® straps or any other suitable fastening means can be attached to support members 310 to removably secure the plurality of walls 308 to the roof assembly.

Figure 44:
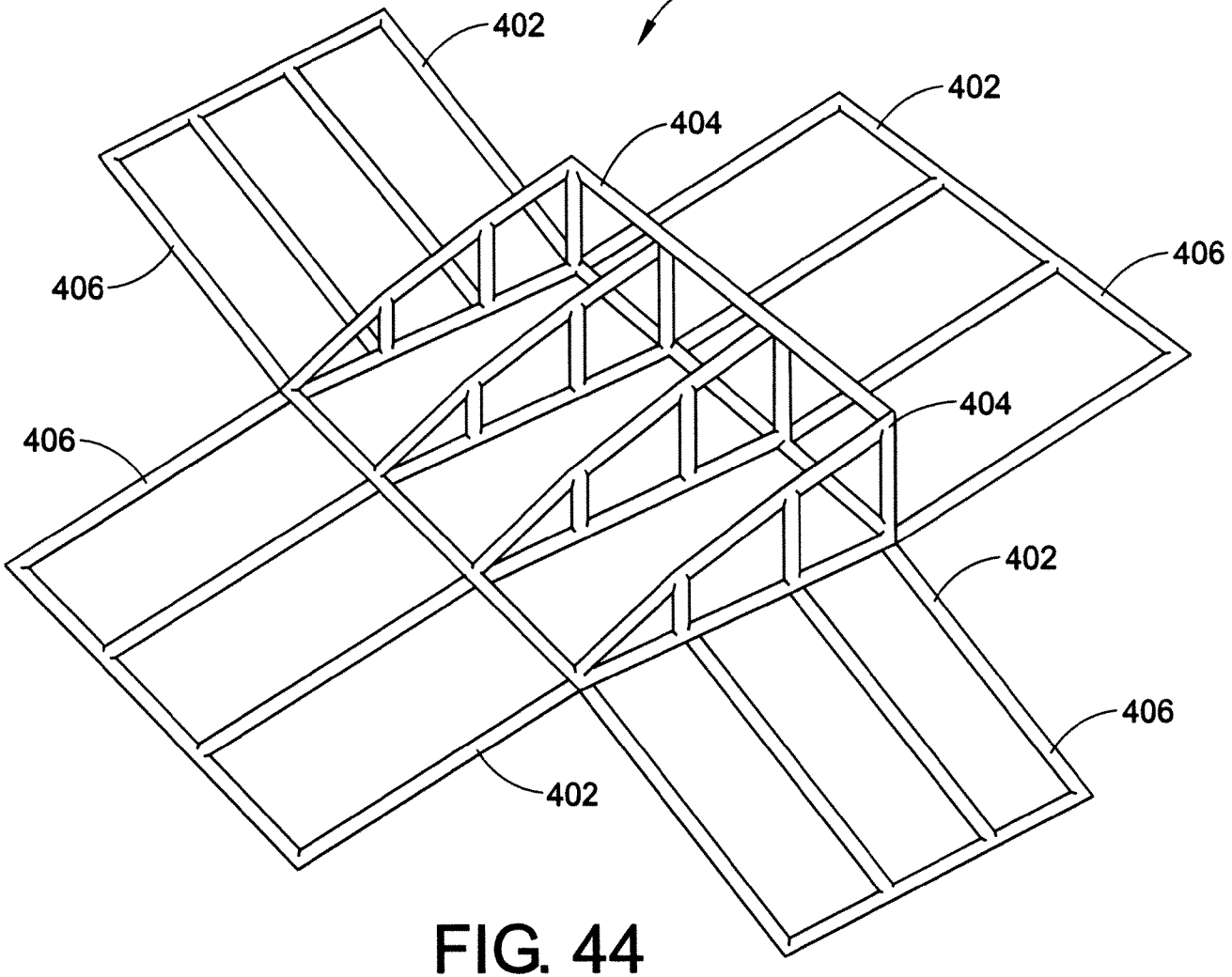
FIG. 44 is a perspective view of a foldable support frame assembly in accordance with another aspect of the disclosure.

Referring now to FIG. 44, a frame support assembly 400 is shown in accordance with another aspect of the disclosure. Support assembly 400 is formed by support members 402 which are hollow and are integrally formed, along with roof support members 404.

The assembly can be folded up into a compact shape or configuration where each side wall 406 is collapsed or folded on each other. The folded up configuration can be square shaped, or the support members can be rolled on top of each other.

To use the assembly, the assembly is either unfolded or unrolled into the configuration shown in FIG. 44. Then, either air, water or foam is pumped into the structure to inflate each support member. The structure is then positioned into the configuration shown such as in FIG. 35 or 39.

Thus, the structure is a one-piece assembly in which the foam is injected to inflate the structure into the use or final configuration such as shown in FIGS. 35 and 39.

Figure 45:
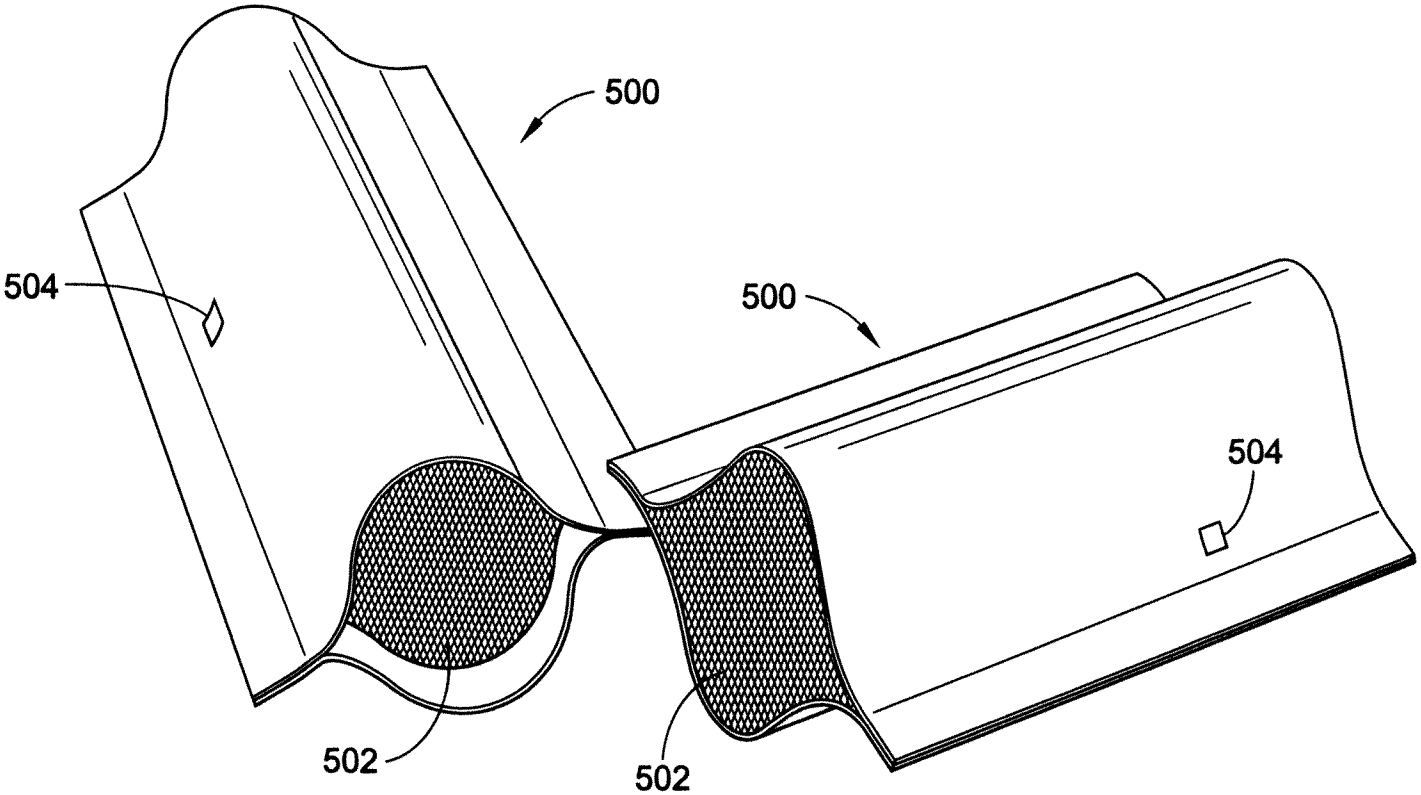
FIGS. 45 and 45A are a perspective and cross sectional view of a support frame and baffle member.
Figure 45A:
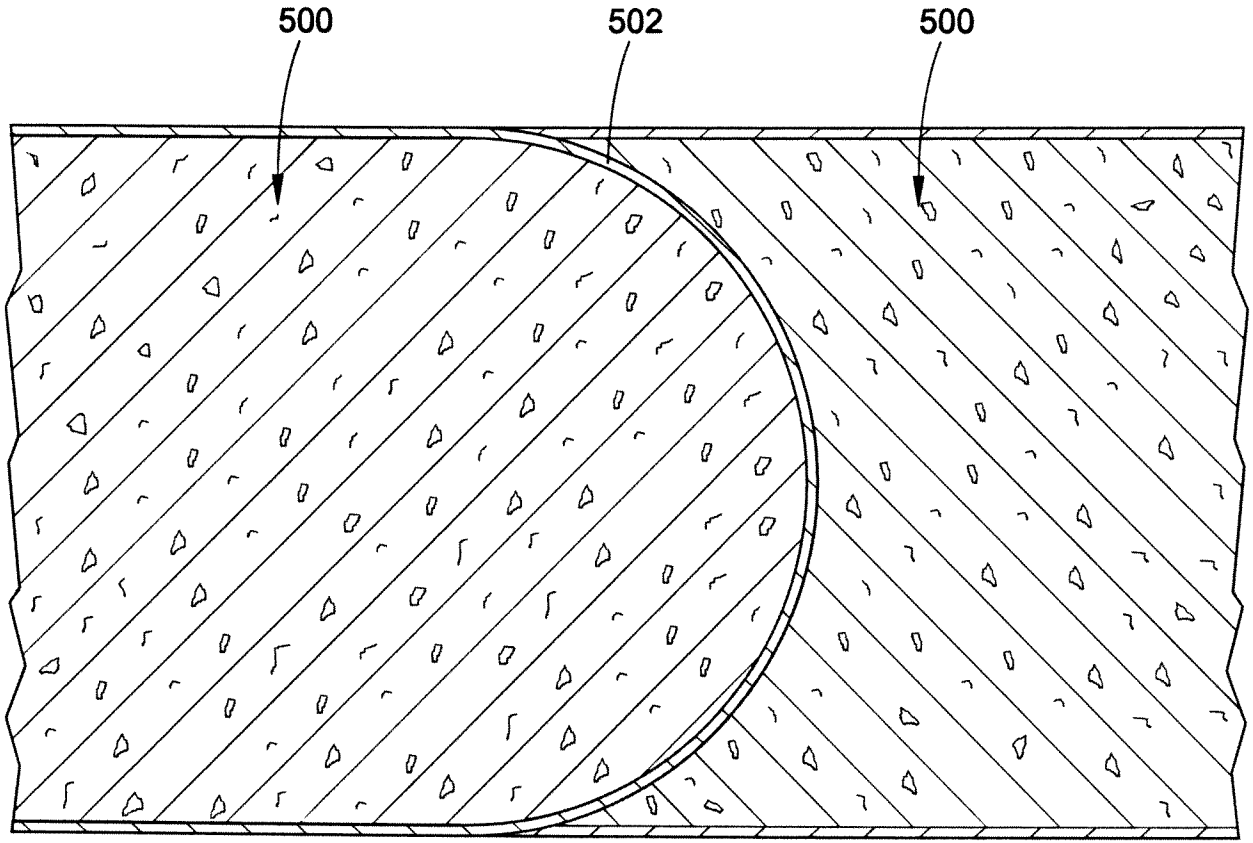

Referring now to FIGS. 45 and 45A, baffles in support members 500 can be in the form of a fine mesh material 502. The mesh is made of a fine weave such that it allows the foam to push against it while retaining the foam in place and allowing gas to escape. For example, the fine mesh can be made of nylon such as used in fabricating tents. Only two fill ports 504 are needed, one on each side of the baffle which is preferably centrally positioned can control movement and injection of the foam on either side of the baffle but not limited to same.

The support member can preferably be made from a long tube which is sealed at each end and has a baffle formed in the middle for controlling filling of each side. The filling can occur in two opposite directions simultaneously but not limited to same.

Figure 46:
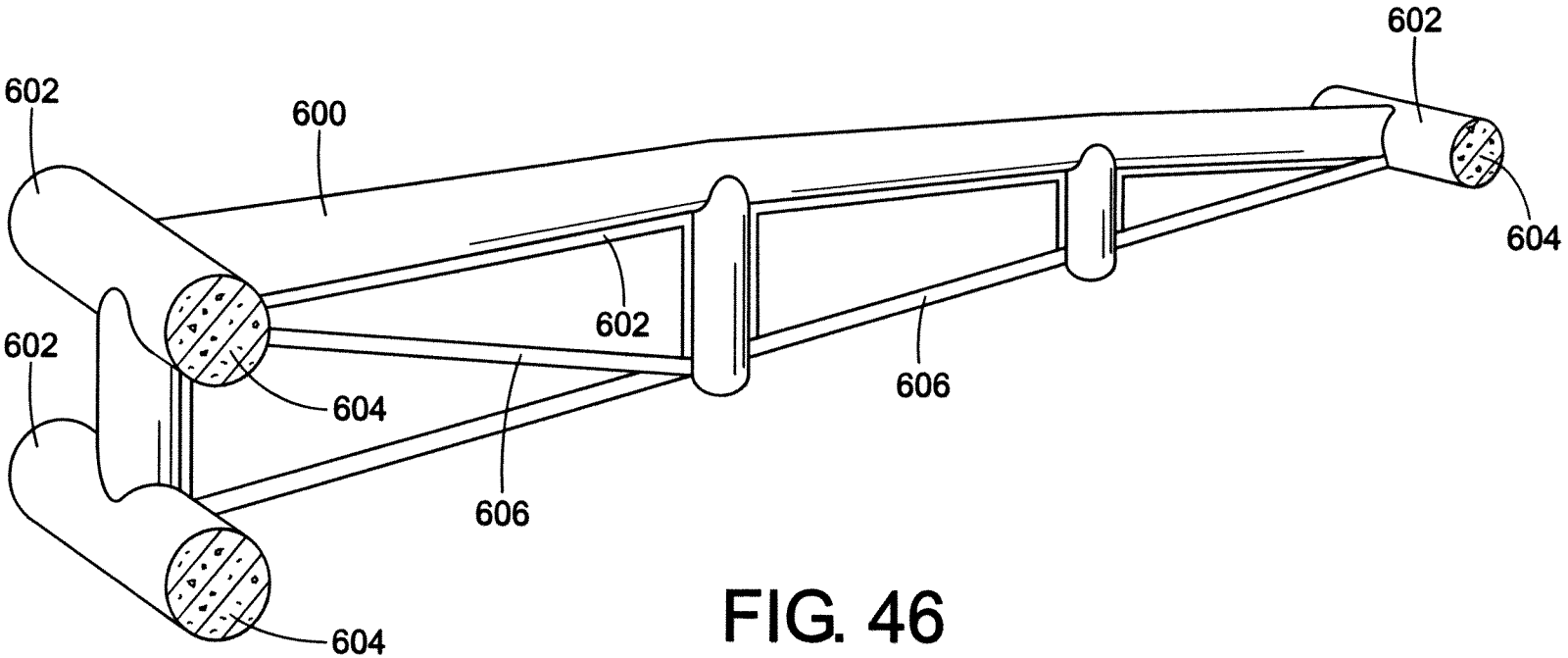
FIG. 46 is a perspective view of a roof support frame in partial cross section having straps thereon.

FIG. 46 illustrates a roof support member 600 which has support members 602 is filled with foam 604. Instead of foam in the bottom support members, a strap 606 can be used instead.

The exemplary embodiment has been described with reference to the preferred embodiments. Obviously, modifications and alterations will occur to others upon reading and understanding the preceding detailed description. It is intended that the exemplary embodiment be construed as including all such modifications and alterations.

The invention claimed is:

1. A shelter assembly comprising: a frame comprising a plurality of inflatable support members, each inflatable support member comprising a hollow portion for receiving a foam filling material;

two fill valves for inserting the foam filling material;

venting holes that are sized to allow gas to flow out of the inflatable support member and prevent foam filling material from passing through and are open when inserting the foam filling material; and a baffle located within the hollow portion and located between the two fill valves;

wherein the baffle prevent foam from flowing past the baffle;

wherein said plurality of inflatable support members are connected together and configured to form a structure wherein said plurality of inflatable support members form at least a portion of one or more walls of said structure.

2. The shelter assembly of claim 1, wherein said plurality of inflatable support members are filled with expandable foam filling material.

3. The shelter assembly of claim 2, wherein said expandable foam filling material is polyurethane foam.

4. The shelter assembly of claim 1, wherein said plurality of inflatable support members are filled with castable foam filling material.

5. The shelter assembly of claim 1, wherein said plurality of inflatable support members comprise tubes.

6. The shelter assembly of claim 1, wherein a door is formed between adjacent inflatable support members in one of said one or more walls.

7. The shelter assembly of claim 1, wherein a window is formed between adjacent inflatable support members in one of said one or more walls.

8. The shelter assembly of claim 1, wherein a roof formed by a sheet of material is secured to one of said one or more walls by fastening means.

9. The shelter assembly of claim 1, further comprising a roof formed by inflatable support members.

10. The shelter assembly of claim 9, wherein said roof support members are curved to form an arched roof.

11. The shelter assembly of claim 1, further comprising a panel having ribbed stiffeners wherein said panel is secured to one of said one or more walls of said structure.

12. The shelter assembly of claim 11, wherein chambers are formed between said stiffeners wherein said chambers are filled with foam filling material.

13. The shelter assembly of claim 12, wherein said foam filling material is a castable material.

14. The shelter assembly of claim 1, further comprising a panel comprising chambers joined by pivot joints, wherein said panel is attached to one of said walls of said shelter assembly.

15. The shelter assembly of claim 14, wherein each of said chambers is substantially filled with filling material.

16. The shelter assembly of claim 1, further comprising a panel comprising outer chambers which surround central inner chambers, wherein said outer chambers are filled with foam filling material and said inner chambers are filled one of with air, gas, water and castable material wherein said panel is secured to one of said one or more walls of said shelter assembly.

17. The shelter assembly of claim 1, further comprising a panel with stiffeners staggered along a length of said panel, wherein chambers are formed between said stiffeners, wherein said panel is secured to one of said walls of said shelter assembly.

18. The shelter assembly of claim 1, further comprising a panel formed between two tubular fillable chambers, wherein said panel is secured to one of said one or more walls of said shelter assembly.

19. The shelter assembly of claim 1, wherein said at least one filling valve comprises a flexible sealing valve.

20. The shelter assembly of claim 19, wherein said flexible sealing valve comprises a slit.

21. The shelter assembly of claim 20, wherein said flexible sealing valve comprises a flange.

22. The shelter assembly of claim 1, wherein said at least one filling valve comprises extension tubes which allows filling material to be filled in one or more directions.

23. The shelter assembly of claim 22, wherein said filling valve comprises a substantially t-shaped valve.

24. The shelter assembly of claim 1, further comprising a joining member with a surface which secures adjacent inflatable support members.

25. The shelter assembly of claim 1, wherein said baffle allows gas to penetrate said baffle.

26. The shelter assembly of claim 25, wherein said baffle comprises a fine mesh material.

27. A shelter assembly comprising:

a plurality of inflatable columns which form corner posts of a structure;

the plurality of inflatable of inflatable columns having a fill valve and one or more vent openings;

a plurality of walls which are removably attached to a pair of adjacent inflatable columns, wherein said plurality of walls comprise inflatable support members to which at least one panel is attached, wherein said inflatable support members are secured to a pair of adjacent inflatable columns via one or more fasteners;

an upper portion forming a roof of said structure, the upper portion comprising one or more coupling members;

wherein said plurality of inflatable columns are attached to one or more coupling members of said upper portion by inserting one or more of the plurality of inflatable columns into the one or more coupling members prior to inflating one or more of the plurality of inflatable columns.

28. The shelter assembly of claim 27, wherein said coupling members of said upper portion comprise cavities for matingly receiving an upper portion of one of said columns.

29. The shelter assembly of claim 27, wherein the one or more fasteners comprise straps.

30. The shelter assembly of claim 27, further comprising sealing flaps which cover said one or more of the plurality of inflatable columns and adjacent support members in a corner of said structure.

31. The shelter assembly of claim 27, wherein said upper portion is secured to one or more of said plurality of walls by fastening means.

32. An inflatable structure:

the inflatable structure providing a shelter;

the shelter having a plurality of inflatable tubes;

the plurality of inflatable tubes each having a hollow portion that extends along a longitudinal axis;

each inflatable tube comprising a first fill valve on a first end of the hollow portion on a first end of the longitudinal axis; a second fill valve, a baffle located inside the hollow portion and between the first and second fill valves and vents;

wherein the baffle prevents foam from flowing past the baffle;

wherein the fill valve is open during the filling process and allows foam fillable material to flow into the plurality of inflatable tubes and the vents are sized to allow gas to flow out of the inflatable tubes and prevent foam fillable material from flowing out of the inflatable tubes through the vents.

33. The inflatable structure of claim 32 wherein one or more of the plurality of inflatable tubes form a support column.

34. The inflatable structure of claim 32 wherein one or more of the plurality of inflatable tubes form a header.

35. The inflatable structure of claim 32 wherein one or more of the plurality of inflatable tubes form a horizontal support.

36. The inflatable structure of claim 32 wherein one or more of the plurality of inflatable tubes have a cylindrical shape.

37. The inflatable structure of claim 32 wherein one or more of the plurality of inflatable tubes have a non-cylindrical shape.

* * * * *